US008026464B2

(12) United States Patent
Romeo et al.

(10) Patent No.: US 8,026,464 B2
(45) Date of Patent: Sep. 27, 2011

(54) MULTI-PURPOSE FOOD PREPARATION KIT

(75) Inventors: Derek Joseph Romeo, Grayslake, IL (US); Paul Andrew Cogley, Chicago, IL (US); Amy Lynn Matusheski, Gurnee, IL (US); Keith Eric Petrofsky, Round Lake, IL (US); Peter Privert, Naperville, IL (US); Uraiwan Tangprasertchai, Iverness, IL (US); Steven Paul Greiner, Mundelein, IL (US); Neil Edward Darin, Grayslake, IL (US); Joseph R. Brooks, Chicago, IL (US)

(73) Assignee: Nestec S.A., Vevey (CH)

( * ) Notice: Subject to any disclaimer, the term of this patent is extended or adjusted under 35 U.S.C. 154(b) by 104 days.

(21) Appl. No.: 11/069,818

(22) Filed: Feb. 28, 2005

(65) Prior Publication Data

US 2005/0230383 A1 Oct. 20, 2005

(51) Int. Cl.
*H05B 6/80* (2006.01)

(52) U.S. Cl. ..... 219/730; 219/729; 426/114

(58) Field of Classification Search ..... 219/728–732, 219/725, 735, 759, 734; 426/107, 110, 94, 426/234, 443, 549; 229/104, 117.01, 120, 229/120.32, 206, 229; 99/DIG. 14
See application file for complete search history.

(56) References Cited

U.S. PATENT DOCUMENTS

| | | | |
|---|---|---|---|
| D25,726 | S | 6/1896 | Leonard |
| 955,033 | A | 4/1910 | Wing |
| 1,361,882 | A | 12/1920 | List |
| 1,415,402 | A | 5/1922 | Rossbach |
| 1,884,699 | A | 10/1932 | Hothersall |
| D120,240 | S | 4/1940 | Hobson |
| 2,315,475 | A | 3/1943 | Cobb et al. |
| D207,492 | S | 4/1967 | Johnson |
| D220,967 | S | 6/1971 | Schneider |
| 3,835,280 | A | 9/1974 | Gades et al. |
| 3,851,574 | A | 12/1974 | Katz et al. |
| 3,861,576 | A | 1/1975 | Tolaas et al. |
| 3,965,323 | A | 6/1976 | Forker, Jr. et al. |

(Continued)

FOREIGN PATENT DOCUMENTS

| | | |
|---|---|---|
| EP | 0242026 A2 | 10/1987 |

(Continued)

OTHER PUBLICATIONS

U.S. Appl. No. 29/200,575, Cogley, Paul.

(Continued)

*Primary Examiner* — Quang Van
(74) *Attorney, Agent, or Firm* — K&L Gates LLP

(57) ABSTRACT

Multi-purpose food preparation kits for foods which include dough, at least a portion of which is exposed for cooking, browning, and crisping, and optionally rising. The kits include a support base of susceptor material elevated above a support surface by an elevator member either incorporated with a base or separate therefrom. Kits further include a ring component of susceptor material which surrounds the food product, and which is dimensioned larger than the initial dimensions of the food product, so as to be spaced therefrom, at least initially, prior to cooking. The space inside the ring component allows the dough to rise during cooking without obstruction by the susceptor ring and without imparting thermal energy from the susceptor ring to the dough surface. In one embodiment the susceptor base is provided in the form of a shipping carton.

9 Claims, 21 Drawing Sheets

U.S. PATENT DOCUMENTS 3,975,552 A 8/1976 Stangroom
4,027,132 A 5/1977 Levinson
4,096,948 A 6/1978 Kuchenbecker
4,176,591 A 12/1979 Power
D254,770 S 4/1980 Christen, Jr.
4,228,945 A 10/1980 Wysocki
4,230,924 A 10/1980 Brastad et al.
4,260,060 A 4/1981 Faller
4,265,393 A 5/1981 Orchard
4,267,420 A 5/1981 Brastad
4,283,427 A 8/1981 Winters et al.
D262,192 S 12/1981 Wedge
4,345,133 A 8/1982 Cherney et al.
4,355,757 A 10/1982 Roccaforte
4,360,107 A 11/1982 Roccaforte
4,369,346 A 1/1983 Hart et al.
D269,243 S 6/1983 Lam
4,390,554 A 6/1983 Levinson
4,441,626 A 4/1984 Hall
4,450,334 A 5/1984 Bowen et al.
D274,495 S 7/1984 Bowen et al.
D275,636 S 9/1984 Picozza
D277,646 S 2/1985 Jorgensen
4,505,391 A 3/1985 Kuchenbecker
4,567,341 A 1/1986 Brown
4,592,914 A 6/1986 Kuchenbecker et al.
D286,508 S 11/1986 Tilden
D288,891 S 3/1987 Saito
4,661,671 A 4/1987 Maroszek et al.
4,676,151 A 6/1987 Gorsuch et al.
D292,676 S 11/1987 Mileto
4,738,365 A 4/1988 Prater
4,745,249 A 5/1988 Daniels
4,749,581 A 6/1988 Gorsuch et al.
4,785,160 A 11/1988 Hart
4,794,005 A 12/1988 Swiontek
4,801,774 A 1/1989 Hart
D300,895 S 5/1989 Watson et al.
4,826,072 A 5/1989 Hart et al.
4,836,383 A 6/1989 Gordon et al.
4,871,111 A 10/1989 Mode
4,877,932 A 10/1989 Bernstein et al.
4,882,463 A 11/1989 Kyougoku et al.
4,883,195 A 11/1989 Ott et al.
4,888,459 A * 12/1989 Keefer ..... 219/728
4,891,482 A 1/1990 Jaeger et al.
4,896,009 A 1/1990 Pawlowski
4,906,806 A 3/1990 Levinson
4,923,704 A 5/1990 Levinson
4,927,991 A 5/1990 Wendt et al.
4,930,843 A 6/1990 Lewis
4,935,592 A 6/1990 Oppenheimer
4,940,867 A 7/1990 Peleg
D311,493 S 10/1990 Boone
4,960,598 A 10/1990 Swiontek
D315,309 S 3/1991 Baughman
D315,475 S 3/1991 Finger et al.
D315,849 S 4/1991 Brunner
5,028,754 A * 7/1991 Chiba ..... 219/734
5,041,295 A 8/1991 Perry et al.
5,071,062 A 12/1991 Bradley et al.
5,076,434 A 12/1991 Hoffman, Jr.
5,077,455 A 12/1991 Peleg et al.
D322,940 S 1/1992 Rivera
5,117,078 A 5/1992 Beckett
5,140,119 A 8/1992 Brown et al.
5,153,402 A 10/1992 Quick et al.
5,173,580 A 12/1992 Levin et al.
D332,897 S 2/1993 Bucher et al.
5,223,685 A 6/1993 DeRienzo, Jr.
5,227,599 A 7/1993 Mason et al.
5,229,564 A 7/1993 Chiba
D338,621 S 8/1993 Balson
5,232,609 A 8/1993 Badinier et al.
5,239,153 A 8/1993 Beckett
5,247,149 A 9/1993 Peleg
D340,023 S 10/1993 Geran
5,254,820 A 10/1993 Pesheck et al.
5,260,070 A 11/1993 Peleg
5,281,432 A 1/1994 Zallie et al.
5,288,962 A 2/1994 Lorence et al.
5,310,977 A 5/1994 Stenkamp et al.
5,331,135 A 7/1994 Ovadia
5,346,312 A 9/1994 Mabry et al.
5,350,904 A 9/1994 Kemski et al.
5,357,086 A 10/1994 Turpin et al.
D352,455 S 11/1994 Balson
D354,681 S 1/1995 Nolte
5,385,292 A 1/1995 LaBianca et al.
5,391,864 A 2/1995 Bodor et al.
5,411,014 A 5/1995 Paul
5,416,304 A 5/1995 De La Cruz et al.
5,416,305 A 5/1995 Tambellini
5,416,606 A 5/1995 Katayama et al.
5,428,209 A 6/1995 Babu et al.
5,445,286 A 8/1995 Guimarin
5,482,724 A 1/1996 Morici et al.
5,503,063 A 4/1996 Sebald
5,510,132 A 4/1996 Gallo, Jr.
5,521,361 A 5/1996 Strait, Jr.
5,542,540 A 8/1996 Knapp et al.
5,543,606 A 8/1996 Gics
5,556,026 A 9/1996 Blankitny
D374,793 S 10/1996 Eickel
5,565,228 A 10/1996 Gics
5,585,027 A 12/1996 Young
5,680,956 A 10/1997 Woodward et al.
5,688,427 A 11/1997 Gallo, Jr.
5,743,402 A 4/1998 Gics
D406,759 S 3/1999 Lawrence
5,900,264 A 5/1999 Gics
5,928,555 A 7/1999 Kim et al.
5,948,308 A 9/1999 Wischusen, III
5,986,248 A 11/1999 Matsuno et al.
6,019,511 A 2/2000 Thomas et al.
6,054,697 A 4/2000 Woodward et al.
6,083,550 A 7/2000 Cochran et al.
6,147,337 A 11/2000 Besser
6,168,812 B1 1/2001 Paulucci
D437,557 S 2/2001 Ingelin et al.
6,211,500 B1 4/2001 Cochran, II et al.
6,211,501 B1 4/2001 McCarthy et al.
6,231,903 B1 5/2001 Ji et al.
6,251,451 B1 6/2001 Zeng
D444,665 S 7/2001 Maier
6,259,079 B1 7/2001 Ji et al.
6,286,708 B1 9/2001 Scheibmeir et al.
6,303,913 B1 10/2001 Bono et al.
6,308,833 B1 10/2001 Oravez
6,359,272 B1 3/2002 Sadek et al.
D458,001 S 5/2002 Shah
6,386,498 B1 5/2002 Deco
6,396,031 B1 5/2002 Forrester
D460,598 S 7/2002 Shah
6,414,288 B1 7/2002 Bono et al.
6,414,290 B1 7/2002 Cole et al.
D462,264 S 9/2002 Barr et al.
D465,759 S 11/2002 Leutz et al.
6,476,368 B2 11/2002 Aronsson et al.
D466,364 S 12/2002 Demore
6,534,755 B1 3/2003 Paulucci
6,627,862 B1 9/2003 Pedersen
D489,611 S 5/2004 Monsanty
D493,334 S 7/2004 Yang et al.
D506,106 S 6/2005 Ordiway et al.
D511,096 S 11/2005 Demaggio
D511,681 S 11/2005 Cogley et al.
2001/0032843 A1 10/2001 Aronsson
2002/0112614 A1 8/2002 Zoss
2002/0179697 A1 12/2002 Pope
2003/0000948 A1 1/2003 Cole et al.
2003/0049353 A1 3/2003 Lauen et al.
2003/0066831 A1 4/2003 Paulucci
2004/0213883 A1 10/2004 Sadek et al.
2004/0234653 A1 11/2004 Cogley et al.

FOREIGN PATENT DOCUMENTS

| | | | |
|---|---|---|---|
| EP | 0256791 | A2 | 2/1988 |
| EP | 0279659 | A2 | 8/1988 |
| EP | 0296496 | A2 | 12/1988 |
| EP | 0326811 | | 8/1989 |
| EP | 0350660 | A2 | 1/1990 |
| EP | 0350847 | A2 | 1/1990 |
| EP | 0242026 | B1 | 2/1992 |
| EP | 0471969 | A1 | 2/1992 |
| EP | 0471969 | B1 | 2/1992 |
| EP | 0486221 | A1 | 5/1992 |
| EP | 0480433 | A3 | 7/1993 |
| EP | 0499647 | B1 | 4/1995 |
| EP | 0503302 | B1 | 7/1996 |
| EP | 0513076 | B1 | 8/1996 |
| EP | 0943558 | A3 | 10/2000 |
| EP | 1132317 | A1 | 9/2001 |
| EP | 1291298 | A2 | 3/2003 |
| GB | 3011577 | | 6/2003 |
| JP | 4230992 | A2 | 8/1992 |
| JP | 6113947 | A2 | 4/1994 |
| JP | 9169367 | A2 | 6/1997 |
| JP | 2001 120424 | A2 | 5/2001 |
| JP | 2001 292689 | A2 | 10/2001 |
| JP | 2005082197 | | 3/2005 |
| WO | WO 8804529 | A1 | 6/1988 |
| WO | WO 8904585 | A1 | 5/1989 |
| WO | WO 9107861 | | 5/1991 |
| WO | WO 9206895 | A1 | 4/1992 |
| WO | WO 9207341 | A1 | 4/1992 |
| WO | WO 9219511 | A1 | 11/1992 |
| WO | WO 9219515 | A1 | 11/1992 |
| WO | WO 9220199 | | 11/1992 |
| WO | WO 9303979 | | 3/1993 |
| WO | WO 9533360 | A1 | 12/1995 |
| WO | WO 9808750 | A1 | 3/1998 |
| WO | WO 9808752 | A2 | 3/1998 |
| WO | WO 9904638 | A2 | 2/1999 |
| WO | WO 9920116 | A2 | 4/1999 |
| WO | WO 0035770 | A1 | 6/2000 |
| WO | WO 0050316 | A2 | 8/2000 |
| WO | WO 0050317 | A2 | 8/2000 |
| WO | WO 0050318 | A2 | 8/2000 |
| WO | WO 0123276 | A1 | 4/2001 |
| WO | WO 0181200 | A1 | 11/2001 |
| WO | WO 02040374 | A1 | 5/2002 |
| WO | WO 02065843 | A1 | 8/2002 |
| WO | WO 03022059 | A2 | 3/2003 |
| WO | WO 03022710 | A2 | 5/2003 |
| WO | WO 03035507 | A1 | 5/2003 |
| WO | WO 03078012 | A1 | 9/2003 |

OTHER PUBLICATIONS

International Search Report Application No. PCT/US2005/006534, dated Feb. 28, 2005.

* cited by examiner

MULTI-PURPOSE FOOD PREPARATION KIT

FIELD

Food preparation components, especially those used for packaging, and cooking, as well as browning and crisping food products, are disclosed. More particularly, components having susceptor portions for preparing foods which include dough, at least some of which is exposed (i.e., uncovered by other food stuff) for cooking, browning, crisping, and optionally, rising, are disclosed.

BACKGROUND

Heretofore, considerable effort has been expended to provide food products such as frozen pizzas for preparation by a consumer, utilizing conventional gas or electric heated ovens. More recently, with the increasing popularity of microwave ovens, attention has turned to providing consumers with kits and components for preparing dough-containing products such as frozen pizzas. As has been detailed in U.S. Pat. No. 5,416,304, microwave ovens exhibit their own unique challenges when preparing frozen food products. For example, microwave ovens exhibit substantial temperature gradients or non-uniform heating. In addition, frozen dough-containing products have been found to exhibit a nonuniform temperature response to microwave radiation throughout their volume, during a typical heating cycle. As a result, portions of the food item melt or thaw before other portions and this results in localized accelerated heating due to the preferential absorption of microwave energy by liquids being irradiated. As a result of these and other conditions, further improvements in the preparation and packaging of dough-containing food products are being sought.

SUMMARY

Figure 1:
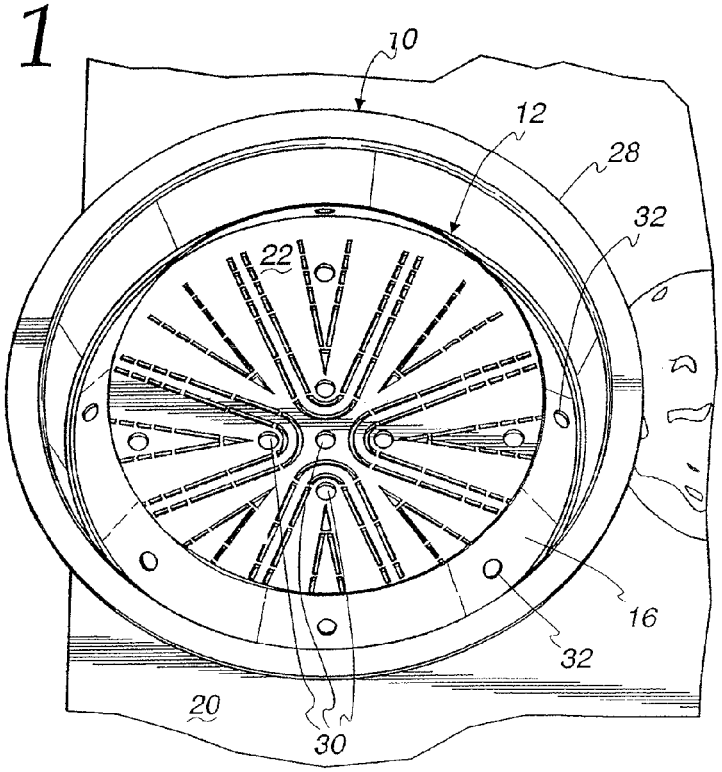
FIG. 1 is a perspective view of a multi-purpose food preparation kit.

Improvements in the field of packaging which are suitable for cooking as well as transport, and in particular to such packaging suitable for use in consumer applications are disclosed.

A package suitable for transporting and thereafter cooking browning and crisping dough products, especially products containing a rising dough, is also disclosed.

Packaging suitable for transporting, cooking, browning and crisping frozen dough products which provides and automatic venting feature during cooking, to allow the escape of a predetermined amount of steam from the dough product is disclosed. It has been found important to allow a certain amount of steam from the dough product to remain in the immediate vicinity of the dough product to facilitate its rapid cooking. Automatic venting of steam from the dough product can be provided to achieve this and other beneficial results.

Food product kits are disclosed containing a ring susceptor for rising dough products, which limit the final stages of expansion of the dough products during cooking, preferably by confining the circumference of the dough products during a final portion of the cooking cycle.

In one aspect, a food product kit for cooking, browning and crisping a rising dough rim is disclosed. The rising dough rim has a first smaller uncooked sized and a second larger cooked size. The food product kit includes a support wall with a susceptor food support surface portion supporting the rising dough rim. There is a susceptor ring above the food support surface which has a susceptor surface facing the rising dough rim. The susceptor ring has a size larger than the first uncooked size of the rising dough rim, and which is approximately the same size as the second, larger, cooked size of the rising dough rim. The susceptor ring is freely supported above the rising dough rim in a manner in which, when the rising dough rim is cooked, it rises and contacts the susceptor surface and its circumference is subsequently confined in size by the susceptor ring surface.

A method is disclosed for microwave cooking, browning and crisping a rising dough rim which first has a smaller uncooked size and a second larger cooked size. The steps include providing a susceptor support for supporting the rising dough rim, and placing the rising dough rim on the susceptor support. A susceptor ring is provided with a larger size than the first size of the dough rim, approximately equal to the second size of said rising dough rim. The susceptor ring is placed over the rising dough rim and the susceptor support, susceptor ring and rising dough rim are heated in microwave oven.

If desired, the susceptor ring can be provided with a plurality of spaced apart tabs, with the susceptor support having complementary slots to guide the tabs and thereby orient the susceptor ring during initial lifting of the susceptor ring above the susceptor support.

The heating step continues so as to heat said susceptor ring so as to cause said rising dough rim to rise, growing in size approaching said second, larger cooked size. Microwave heating is continued until said rising dough rim contacts said susceptor ring, and further until said rising dough rim increases in size so as to conform to said susceptor ring. Microwave heating is further continued to cause said rising dough rim and so as to grow in height while maintaining the surface of rising dough rim to conform to the susceptor ring and so as to raise the susceptor ring above the susceptor support, so as to form a vent space between said susceptor ring and said susceptor support.

It is generally preferred that the susceptor ring be sized larger than the food product. As a result, when cooking is initiated, a substantial portion of the peripheral crust of the pizza is out of contact with susceptor ring 320. With continued cooking, the susceptor ring is heated to a higher temperature than otherwise possible if the susceptor ring were in contact with the food product. Based upon the size difference between the susceptor ring and food product and rate of energy input of the oven, an average time delay can be calculated for the initial contact of the food product with the susceptor ring. Accordingly, an average temperature rise of the susceptor ring prior to contact with the food product can be predicted. Thus, an accurate cooking cycle for a particular susceptor ring and food product can be established to provide the desired consumer satisfaction by having a peripheral crust which is brown and crispy, without being dried.

DETAILED DESCRIPTION

Multi-purpose food preparation components, and especially kits made from such components, are illustrated in FIGS. 1-39. As will be seen herein, the food preparation components are directed to the preparation, i.e., thawing, cooking, browning and crisping, of food items having a dough component. In addition to playing an active role in the food preparation, the kit components provide packaging for the food item throughout its transportation, stocking, sale, and related activities. While the food preparation components are is suitable for use with dough products in general, immediate commercial interest has been expressed for its use with frozen pizza food items of the type sold for consumer preparation using conventional microwave oven devices.

In microwave cooking, polar molecules such as water contained in the food product absorb microwave energy and release heat. Microwave energy typically penetrates further into the food than does heat generated in a conventional oven, such as radiant heat with the result that water molecules disperse throughout the food product are selectively more often more rapidly heated. Ideally, food products such as those in pizzas must properly dissipate the heated moisture in order to avoid the pizza crust becoming soggy.

The food product being prepared may be supported at an elevated position above the oven surface to allow a desirable portion of the moisture exiting the food product to become trapped in a determined volume so as to contribute controlled amounts of heat and moisture to the bottom of the pizza crust and to achieve a desirable brownness or crispness without becoming dried out, chewy or hard. The food product is supported at an elevated position above the oven surface to allow cooking energy, such as microwaves to be deflected underneath the food product, to reach the bottom portion of the food product. Thus, it can be preferable to achieve a proper ratio of moisture exiting the food product being prepared between a trapped portion used for heating of the food product and a released portion which is allowed to escape the food product to prevent its becoming soggy or chewy or otherwise undesirably moist.

Other problems associated with the use of microwave energy for the preparation of food products such as frozen pizza are also addressed. In general, certain instances of non-uniform heating can be associated with the preparation of food using microwave energy, such as electromagnetic radiation at a frequency of about 0.3 to 300 GHz. It can be important in order to achieve a cooked pizza of pleasing appearance and texture that the pizza be uniformly heated throughout the cooking. For example, pizzas are usually prepared having a circular outer shape with the outer periphery comprising an exposed dough which is uncovered, i.e., free of other food items such as tomato sauce or cheese. As is now generally accepted, power distribution in a microwave oven cavity can be non-uniform, giving rise to "hot spots" and "cold spots" about the environment of the food product being prepared.

Another problem in many practical applications arises from the fact that a food product such as a frozen pizza typically does not exhibit desirably uniform temperature response to microwave radiation throughout its volume, during a typical heating cycle. For example, a frozen pizza when initially subjected to microwave radiation, undergoes local melting or thawing in certain portions of the pizza, with remaining portions of the pizza remaining frozen. This problem is accelerated in that thawed portions of a pizza will preferentially absorb greater amounts of microwave energy than the surrounding frozen portions. A further understanding of difficulties encountered in preparing dough-containing food products such as frozen pizza may be found in U.S. Pat. No. 5,416,304, the disclosure of which is herein incorporated by reference as fully set forth herein. It is important therefore that initial thawing of the pizza product be made as uniform as possible throughout the pizza product and that the energy absorption throughout the remainder of the cooking cycle remain uniform. A number of different features of multi-purpose food preparation kits and their individual components disclosed herein provide improved control of dough-containing food products, throughout the cooking cycle. The various components described herein may be arranged in different combinations, other than those specific kit combinations described herein.

Figure 31:
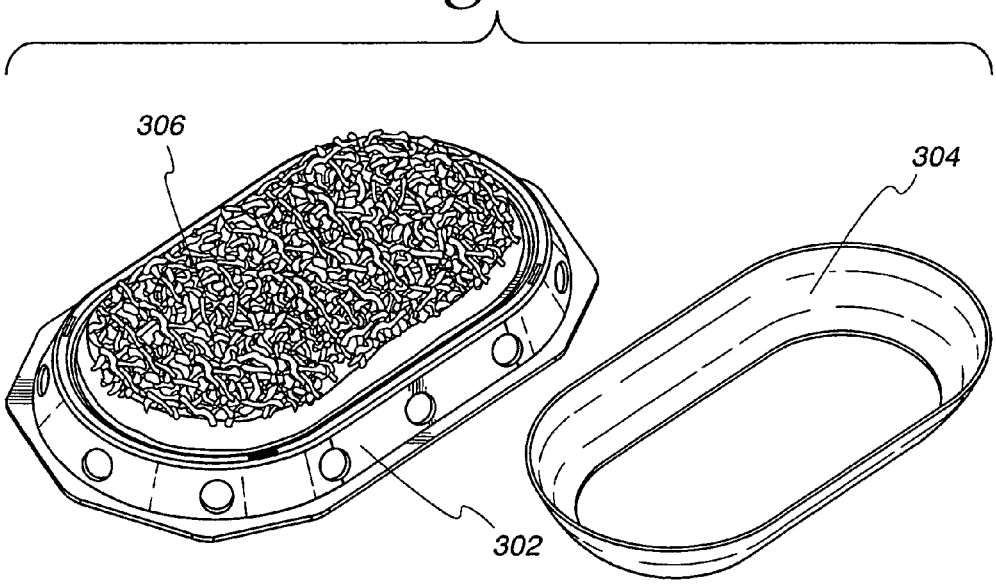
FIG. 31 is an exploded view thereof.

Preferred embodiments of a multi-purpose food preparation kit as illustrated herein are shown as having a circular or multi-sided polygonal form. Other forms such as ovals and other irregular rounded shapes may also be used for the susceptor, support, ring component and other parts of multi-purpose food preparation kits disclosed herein. For example, in FIGS. 30 and 31 a modified oval or rounded rectangle form is shown for the base 302 and susceptor ring 304 of multi-purpose food preparation kit 300. As can be seen in FIG. 31, kit components this elongated shape allow preparation of elongated food products such as the frozen pizza food product 306. If desired, the kit components can take on a shape more closely resembling a rounded rectangle than an oval, with the radius of the rounded corners having a minimal small size so as to avoid overheating the corners of the food product being prepared. It is generally preferred that extremely sharp corners in the kit components, and especially the susceptor ring be avoided because of localized heat build up which may occur. However, with local variations of susceptor coatings in a susceptor ring and other design modifications corners of relatively sharp radius may be employed. Except for the change in shape, various components of kit 300 function in the manner described above with kits having components with a more rounded or circular shape.

The components and methods disclosed herein are particularly suitable for use with food products containing raw dough which is continuously processed during a cooking cycle to expanded dough which is at least partly exposed, with the exposed portions being cooked, browned, and crisped. Raw or unproofed dough used in frozen pizzas tends to exhibit considerable volume expansion during a cooking cycle, especially during the initial phase of the cooking cycle. For example, frozen pizzas using raw or unproofed dough having a 6 in. diameter have been found to exhibit a ¼ inch increase in diameter and a doubling of the height of the outer peripheral raised crust or crust rim portion. The components and methods disclosed herein provide improved adaptation of microwave susceptor materials which surround the peripheral crust rim portion throughout the dough expansion and other portions of the overall cooking cycle. Adaptation of susceptor materials can result in a greater uniformity of heating of food products such as frozen pizzas.

Figure 2:
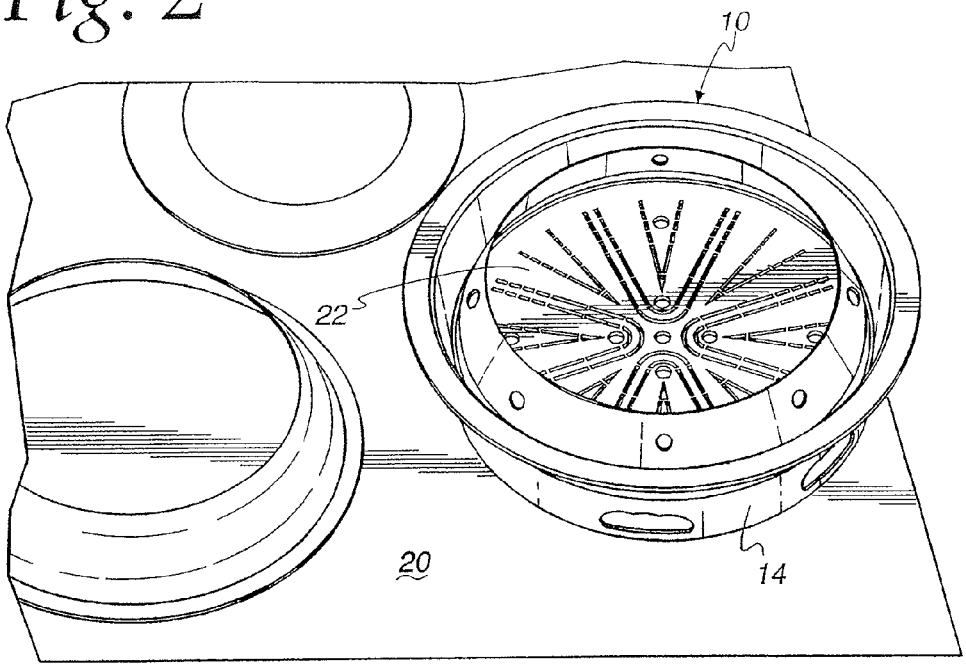
FIG. 2 is another perspective view thereof.
Figure 3:
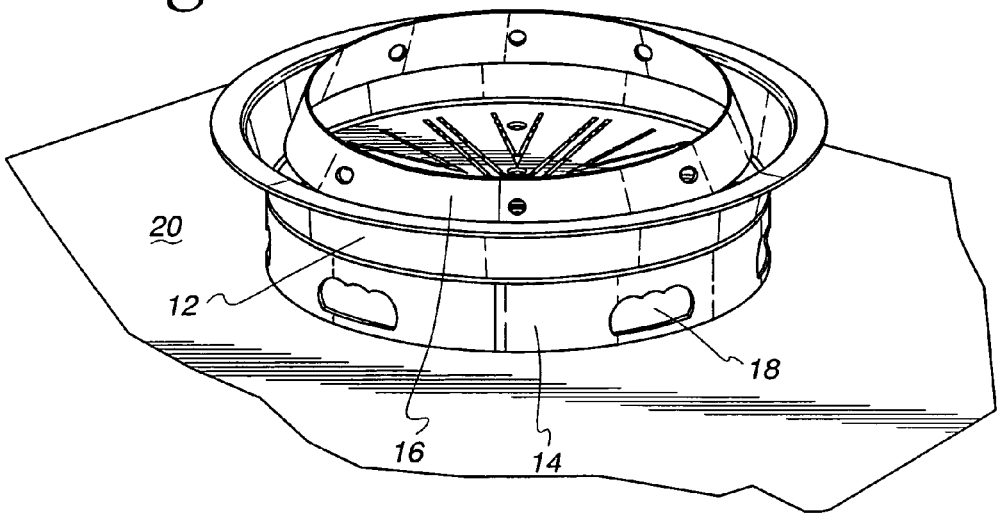
FIG. 3 is a perspective view of another multi-purpose food preparation kit.

Referring now to the drawings, a number of multi-purpose food preparation kits and individual kits components will be described. Referring initially to FIGS. 1-3, a multi-purpose food preparation kit is generally indicated at 10. Kit 10 is especially adapted for preparing frozen pizza food products of the type containing a dough base, tomato sauce, and topped with condiments including cheese. Kit 10 includes a pan 12, a support 14 (See FIGS. 2-3) and a ring component 16. The kit components 12-16 are preferably made of paper board susceptor material that is folded or pressed to assume the desired shape. For example, support 14 has a generally cylindrical shape and defines a series of cut outs or openings. The openings 18 are preferably located in the mid portion of the support but could also be located at its top or bottom edge, if desired. The support 14 cooperates with a support surface 20 and the bottom wall 22 of pan 12 to form a substantially enclosed cavity beneath the food product disposed in pan 12. Preferably, support 14 raises the bottom wall 22 an elevation sufficient to allow for microwaves to reflect off of the sidewalls and bottom wall of a microwave and be directed to the underside bottom wall 22 to provide for heating of the bottom of the pizza or other product, such as 0.25 to 1.25 inches above surface 20 for a frozen pizza product having a diameter of approximately 6 inches.

Pan 12 includes an upstanding sidewall 26 preferably of frusconical shape, but optionally of any conventional shape desired. Pan 12 further includes an upper outwardly extending lip 28. The frozen pizza food product disposed with pan 12 preferably includes an outer crust rim which extends adjacent the lip 28. As can be seen in the figures, a series of holes 30 are formed in bottom wall 22 to allow steam vapor exiting the food product during the cooking cycle to enter the cavity below pan 12 defined in part by support 14 and surface 20. Excess amounts of steam, or water vapor beyond that desired, is allowed to exit the cavity through openings 18. A defined amount of steam is thus trapped beneath pan 12 to provide an amount of additional heating to the food product as well as maintaining moisture control of the food product environment during the cooking cycle.

The cooking ring 16 is shown as having a frusconical shape with a series of holes 32 disposed about its body. In operation, ring 16 is disposed about the outer peripheral crust rim portion of the pizza product so as to provide additional heat energy to the peripheral crust rim portion for browning, crisping and formation of surface crust by conductive heat which is desirable for products of this type. The optional holes 32 in ring 16 allow for moisture venting and may be employed to prevent the food product from becoming soggy, as needed. Preferably, ring 16 is free to ride along with the crust rim portion of the food product, especially during the proofing stage when the dough increases dramatically in size as it rises. Due to the frusconical shape, the ring 16 self centers about the food product, despite shape and size transformations during the cooking cycle. After baking, the ring 16 is easily removed from the top of the food product crust, leaving a desirable crisp, brown edge. The susceptor coating on the inner face of ring 16 may be of any desirable composition and may be the same or different from the susceptor coating on the upper surface of the bottom wall 22 of pan 12. Preferably, the susceptor ring 16 with side openings 32 allows for expansion of the dough during baking. If desired, the susceptor ring 16 can have unjoined overlapping ends so as to be freely expandable with the crust as it rises during microwave baking.

Figure 4:
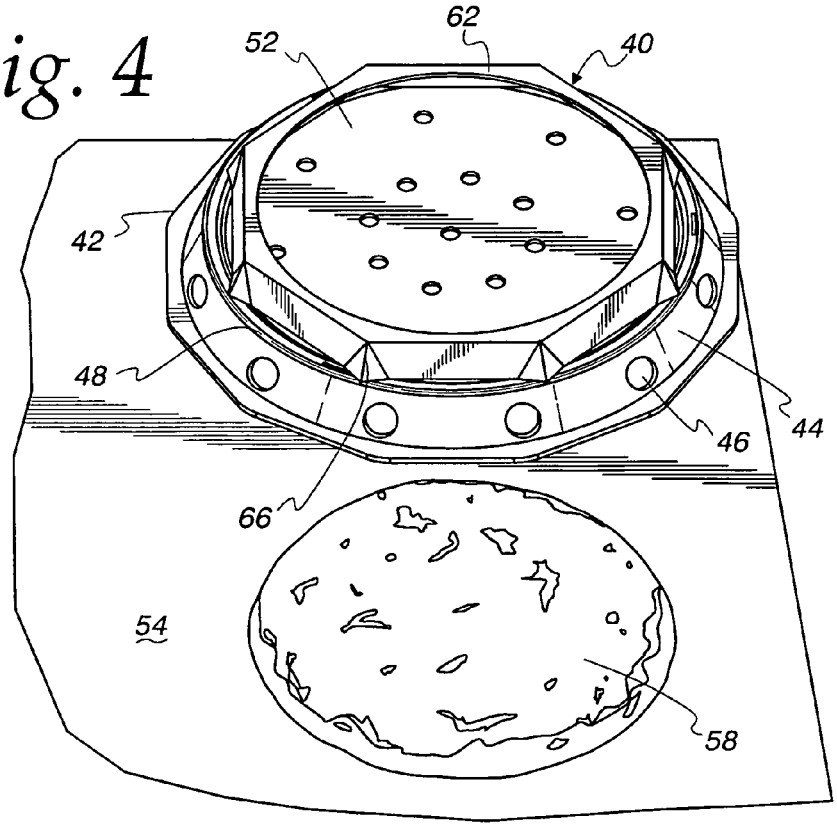
FIG. 4 is a perspective view of another multi-purpose food preparation kit.
Figure 5:
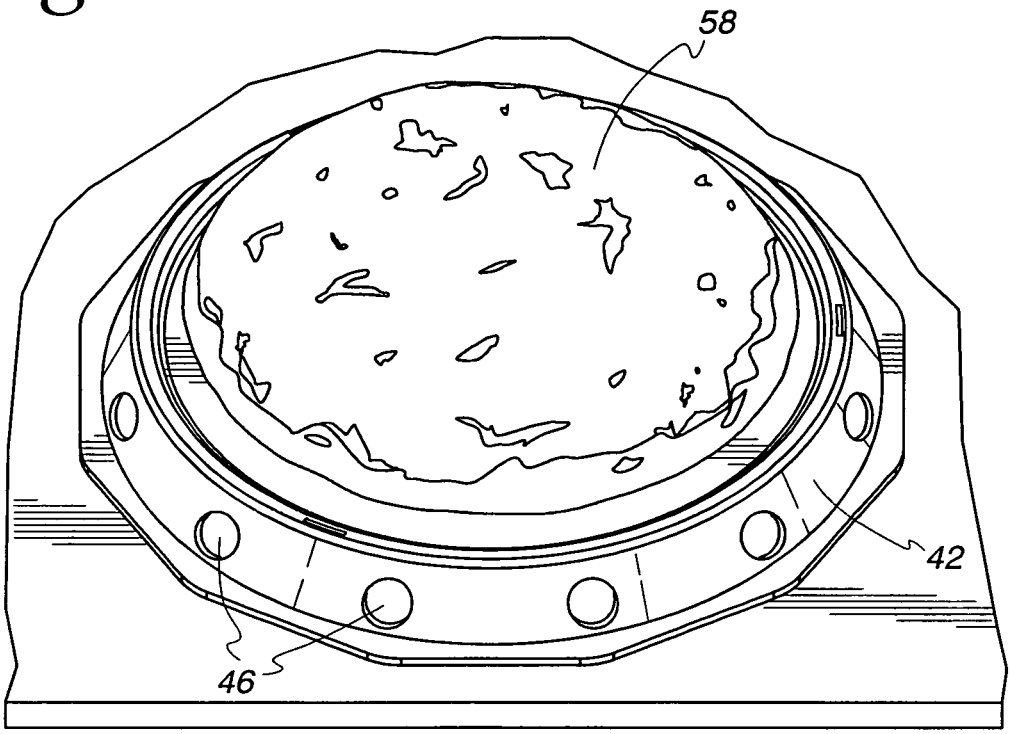
FIG. 5 is a perspective view showing the kit of FIG. 4 with the ring component removed.

Turning now to FIGS. 4-8, a multi-purpose food preparation kit is generally indicated at 40. Kit 40 includes a combined pan and support 42 or base, such as described in U.S. Patent Application Publication US 2004/0234653 A1, the disclosure of which is incorporated herein by reference as if fully set forth herein. The base 42 has a generally frusticonical wall 44 with holes 46 and an upper lip 48. Base 42 further includes a support wall 52 disposed beneath upper lip 48 but above the support surface 54 so as to form a cavity of predetermined dimension beneath the support wall 52. The food product is disposed partially within base 42 as can be seen in FIG. 5.

Figure 6:
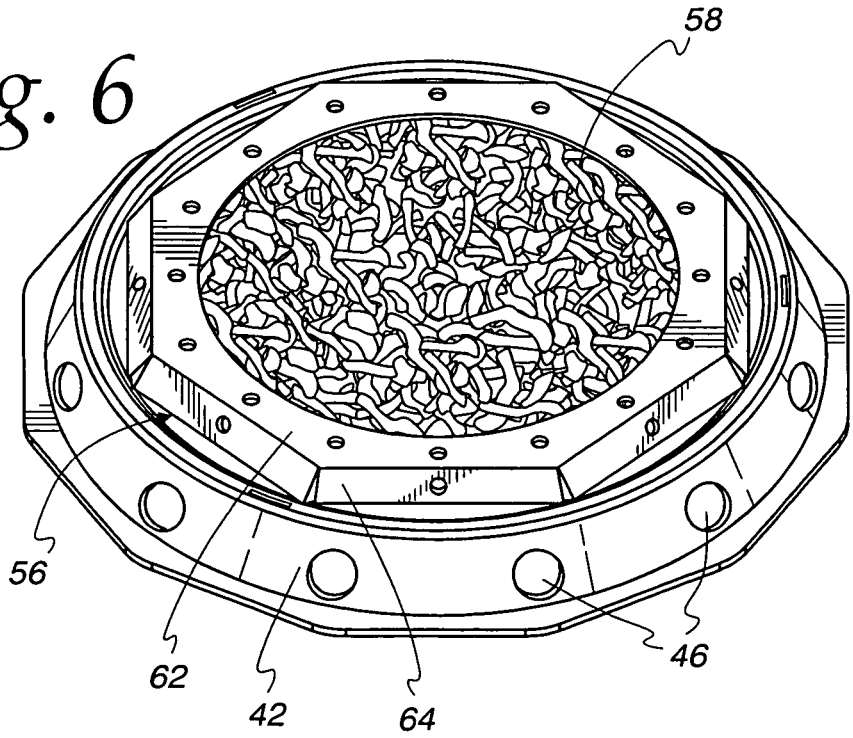
FIG. 6 is a perspective view of a multi-purpose food preparation kit.

A susceptor ring 56 is disposed generally above wall 44, surrounding and resting upon the outer periphery of the frozen pizza food product 58 as can be seen FIG. 6. The susceptor ring 56 has an upper wall 62 with an outer polygonal or multi-faceted edge and a central circular opening. The side walls of the susceptor ring are upwardly and inwardly inclined in pyramidal-type fashion. The central circular opening of the susceptor ring is dimensioned so as to extend across the top of the peripheral crust rim portion of the frozen pizza food product. Preferably, the inner edge of the circular opening remains out of contact with the cheese topping of the food product. If desired, the susceptor ring 56 can initially rest on the upper rim 48 of component 44. However, upon the initial phase of the cooking cycle dough expansion will cause the upper surface of the crust rim portion of the dough to come into contact with the underside of susceptor ring top wall 62.

Preferably, susceptor ring 56 is unconnected, and thus can freely ascend with the peripheral dough portion throughout the cooking cycle to provide a desired intimate contact for conductive heating with the dough which is important in certain instances to achieve the desired amount of browning and crispness of the outer crust of the exposed portion of the crust rim of the food product.

Figure 7:
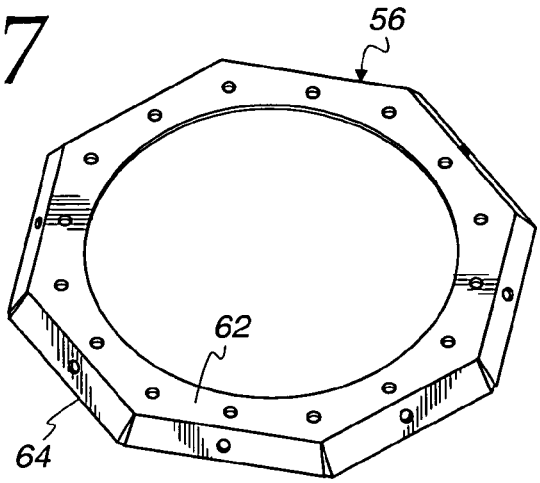
FIG. 7 is a top perspective view of the ring component thereof.
Figure 8:
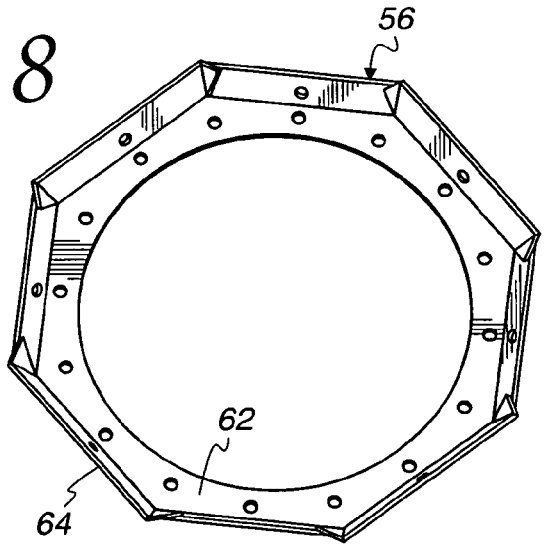
FIG. 8 is a bottom perspective view of the ring component thereof.

As shown in FIG. 4, the side walls of the susceptor ring are solid, and sufficient moisture venting occurs through the gap between the susceptor ring and component 44. If desired, additional venting can be provided in the susceptor ring as shown in FIG. 6 where holes are formed in the top wall 62 and side walls 64 of the susceptor ring 56. The shaped number of holes in the susceptor ring can be varied as desired as can holes 46 in the base 42. FIGS. 7-8 show the perforated susceptor ring 56 in greater detail.

Figure 9:
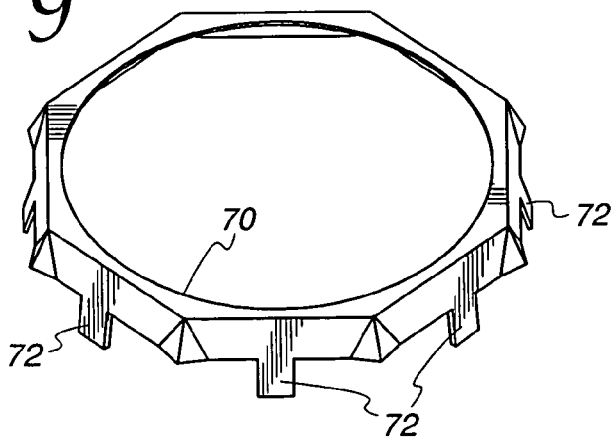
FIG. 9 shows the ring component of FIG. 4.
Figure 10:
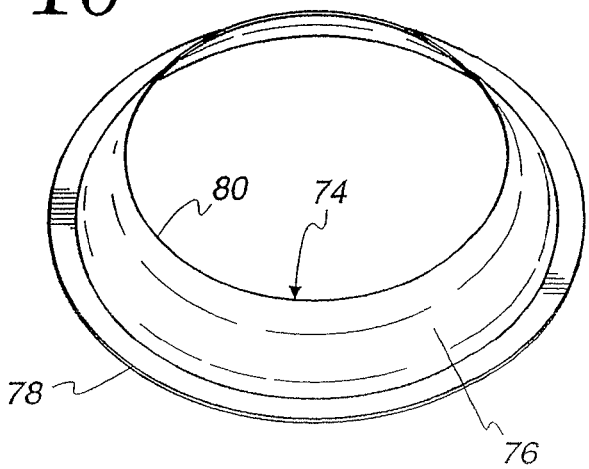
FIG. 10 shows another ring component.
Figure 11:
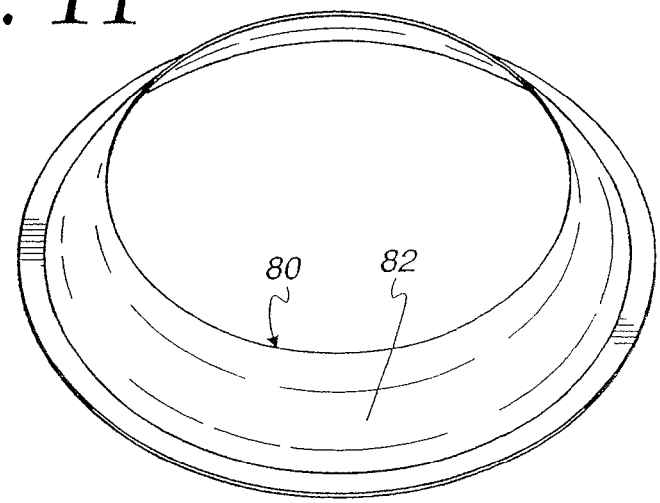
FIG. 11 shows another ring component.
Figure 12:
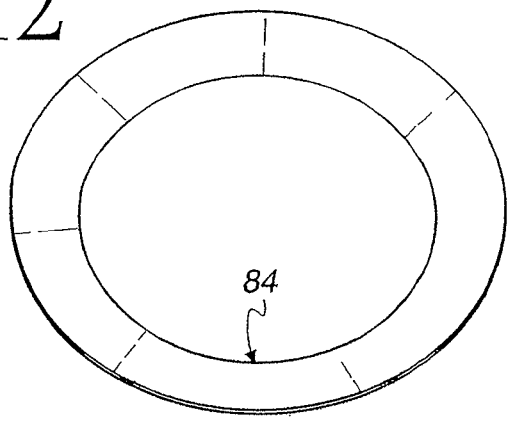
FIG. 12 shows a further embodiment of a ring component.

Referring now to FIGS. 9-12, additional optional susceptor rings are illustrated. In FIG. 9, a susceptor ring 70 is similar to susceptor ring 56 includes tabs 72 which fit in corresponding slots in upper rim 48 (not shown in FIG. 9) to provide alignment with the combined support and pan member 42. (See FIG. 24) If desired, tabs 72 can be elongated so as to freely travel in slots formed in upper rim 48 during dough expansion. FIG. 10 shows a susceptor ring having a frusticonical side wall 76, a lower outwardly expanded lip 78 and an upper inwardly expanding lip 80. Inwardly expanding lip 80 has a relative short radial inward dimension which provides additional hoop strength and exhibits little if any inward contact with the food product dough surface. FIG. 11 shows a susceptor ring 90 having a generally curved or concave side wall 82, while FIG. 12 shows a susceptor 84 of generally flat, annular configuration.

Figure 13:
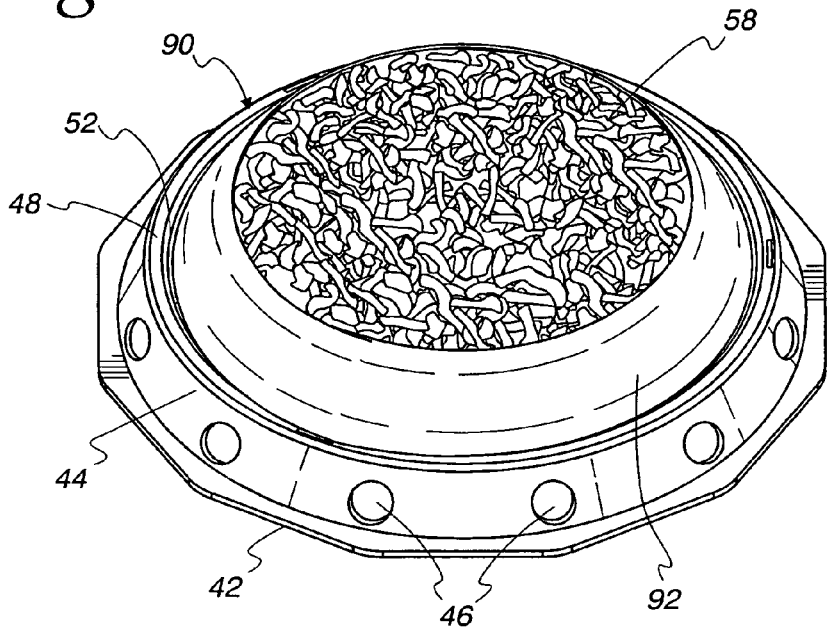
FIG. 13 is a perspective view of another multi-purpose food preparation kit.
Figure 14:
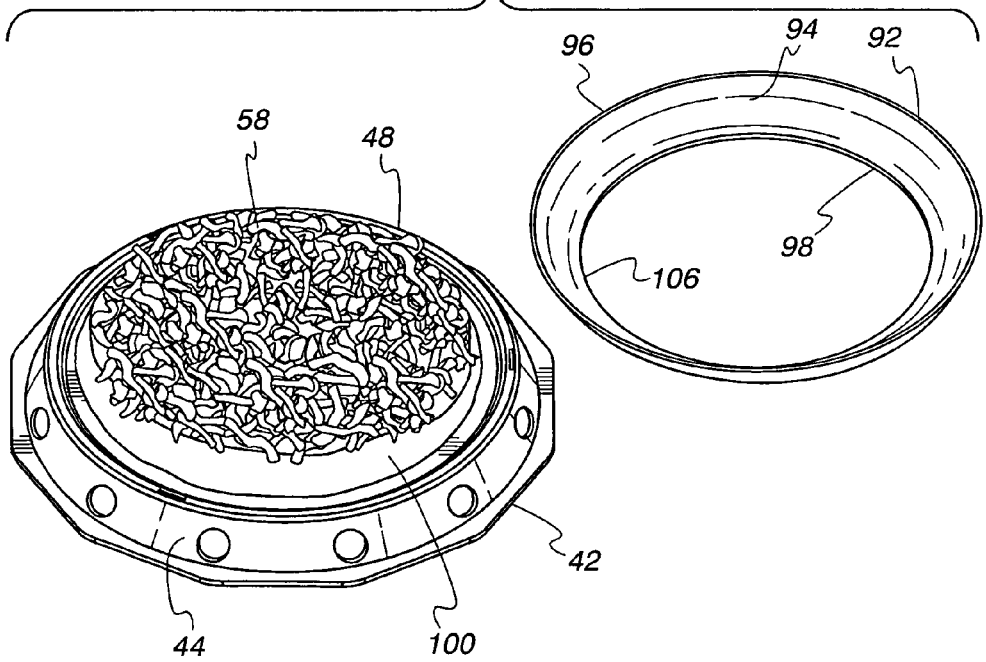
FIG. 14 shows the kit of FIG. 13 with the ring component removed and inverted.
Figure 15:
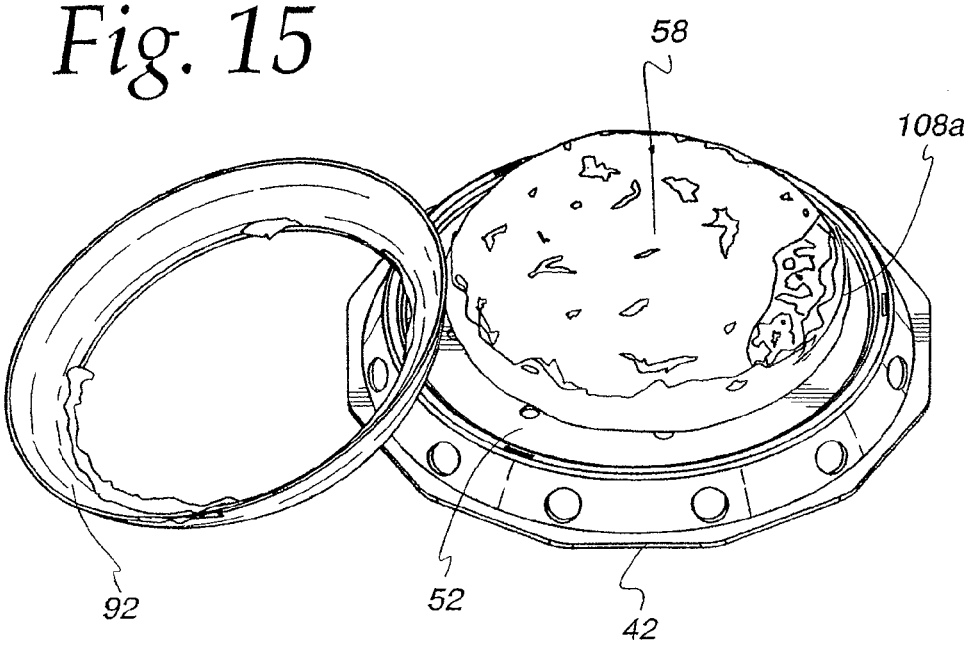
FIG. 15 shows the kit and food product upon completion of a food preparation.

Turning now to FIGS. 13-15 a multi-purpose food preparation kit is generally indicated at 90. Kit 90 includes the base 42 described above with reference to FIGS. 4-6, and a susceptor ring 92. Ring 92 has a curved generally concave wall facing inward toward the frozen pizza food product 58. The inner surface 94, shown for example in FIG. 14 is coated with a suitable susceptor material. Preferably, ring 92 is formed of paper board material which is folded or worked in a press to assume the desired shape. Ring 92 has a bottom edge 96 and an inner, preferably circular edge 98.

Figure 19:
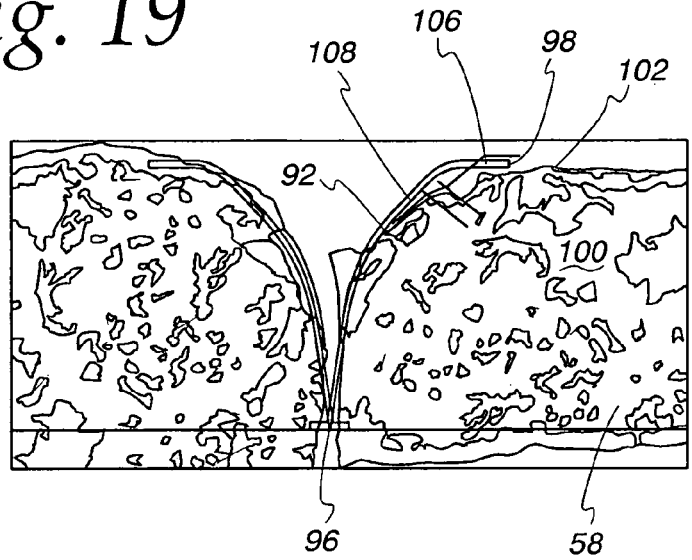
FIG. 19 is a cross and sectional view showing multiple ring component cross sections.

Ring 92, as with the preceding susceptor rings, allows for browning and crisping of the outer pizza crust rim 100 of food product 58 (See FIG. 14). The inner surface portion of ring 92 adjacent central opening 98 either initially or during the cooking cycle contacts the crust rim 100. Referring briefly to FIG. 19, the crust rim portion 100 of the food product has a generally rounded or convex outer surface. Reference numeral 102 indicates the approximate edge of the tomato sauce and cheese topping customarily applied to the pizza dough. The upper portion and central edge 98 of ring 92, as can be seen in FIG. 19, is spaced outwardly beyond edge 102 in order to avoid contact of the susceptor surface with non-dough components, i.e., toppings applied to the frozen pizza dough. As indicated in FIG. 19, ring 92 is shaped to generally conform to the outer surface of the crust rim.

Referring again to FIG. 19, ring 92 includes a stiffener portion or raised rim 106 extending from a point 108 to the central edge 98. Preferably, the raised rim portion 106 is formed so as to depart from, i.e., rise above the top surface of the raised rim 100. The remaining portion of the susceptor ring 92, i.e., that portion extending between point 108 and bottom edge 96 is preferably in intimate contact with or spaced very close to the outer surface of crust rim 100 so as to provide the desired crisping and browning to the crust surface. The raised rim 106 comprises a secondary structural feature that provides added hoop strength, but does not come into contact with the cheese and other toppings on the pizza.

As mentioned, the susceptor ring 92 has a shape which is conformed to the outer surface of the crust rim 100 as is shown in FIG. 19, illustrating a cross section of a fully prepared pizza food product. If the pizza dough being prepared is previously proofed, prior to preparation, the crust rim portion will have a size and shape more closely approximating the finished result shown in FIG. 19. However, as mentioned, the components disclosed herein are preferably employed with dough which is provided in a raw or unproofed form and which undergoes considerably expansion during the cooking cycle. As mentioned, for a 6 inch pizza food product, during the cooking cycle the diameter of the dough increases approximately ¼ inch and the height of the crust rim approximately doubles in size. Accordingly, the susceptor ring 92 is sized slightly larger than the original, frozen food product profile. The components disclosed herein could also be used with dough that does not rise during cooking.

Preferably, the susceptor ring 92 is sized and shaped so as to contact the crust rim portion before or during the dough expansion phase of the cooking cycle. The susceptor ring 92 may act as a forming device that restricts the circumference of the pizza rise to a predicted size and shape profile. This restriction also promotes a maximum amount of susceptor-to-product contact which, as mentioned, is beneficial for browning and crisping of the outer crust. Using different thicknesses of paper board for the susceptor ring body will vary the flexibility of the ring, allowing for more or less conforming with the shape of the pizza crust. Thus, in the preferred embodiment, susceptor ring 92, in addition to providing crisping and browning, acts as a mold which defines the final shape of the prepared food product.

It is generally preferred that the mold function of the susceptor ring 92 occurs over the lower majority of a ring profile (e.g., below 108 in FIG. 19, as shown for one embodiment). If desired, the secondary raised rim 106 can be omitted. Referring to FIG. 15, a fully prepared pizza food product is shown with a profile line **108*a* corresponding to the upper extent of the mold confinement of susceptor ring 92**.

Figure 16:
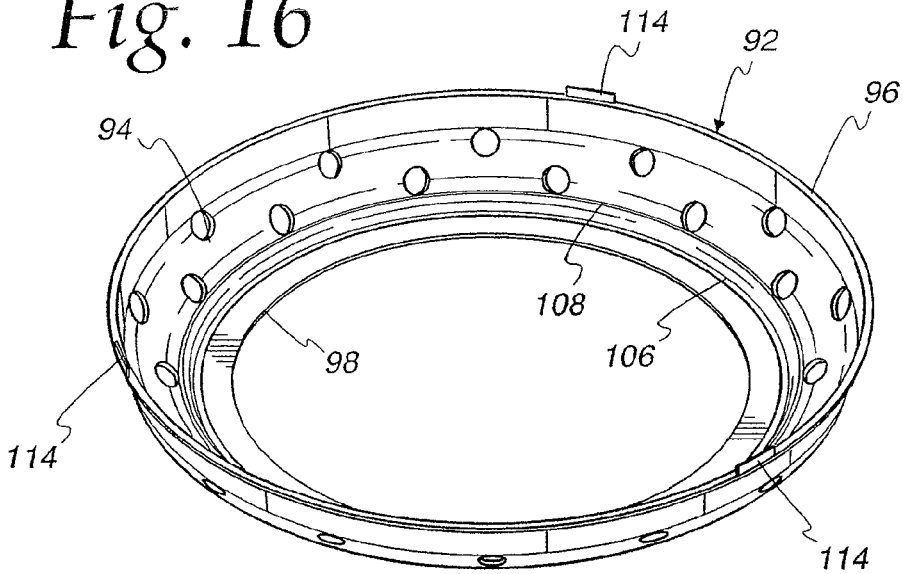
FIG. 16 is a bottom perspective view of the ring component thereof.
Figure 17:
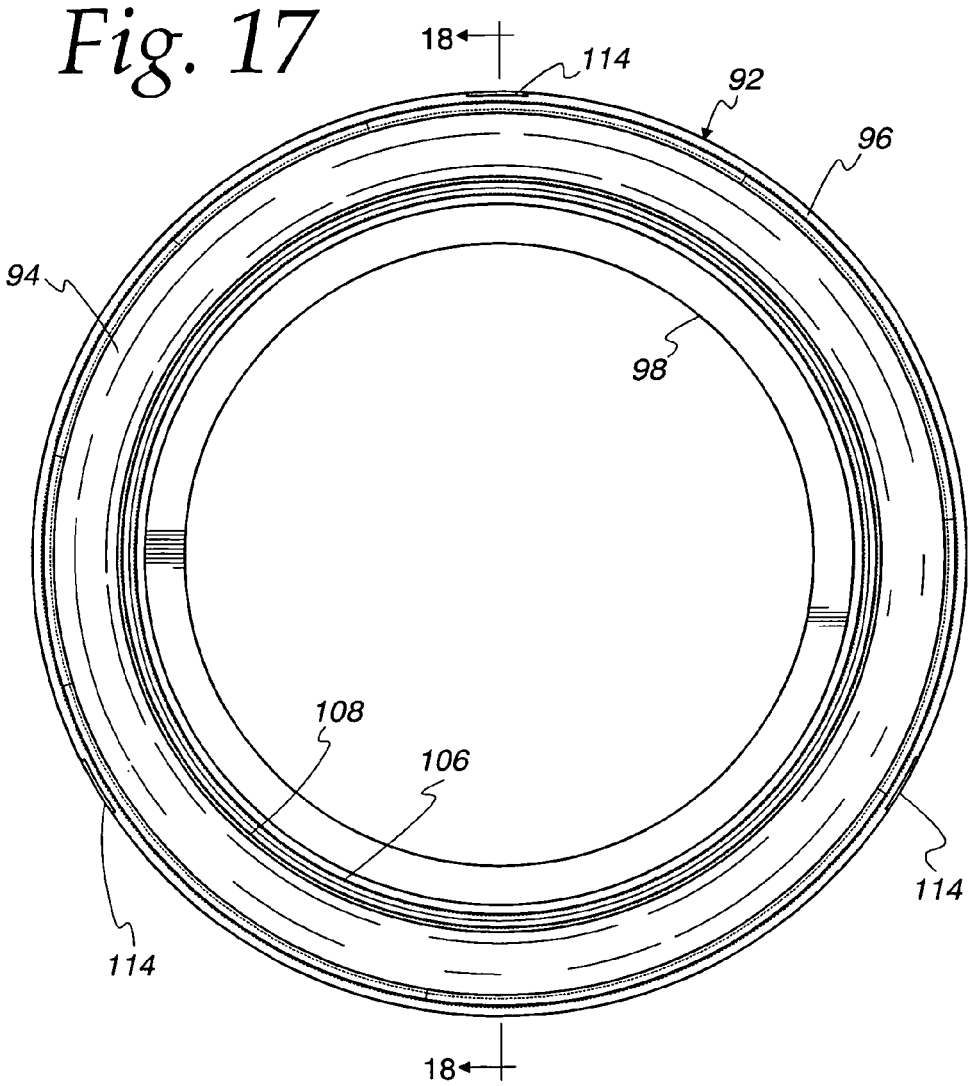
FIG. 17 is a bottom planned view of the ring component thereof.
Figure 18:
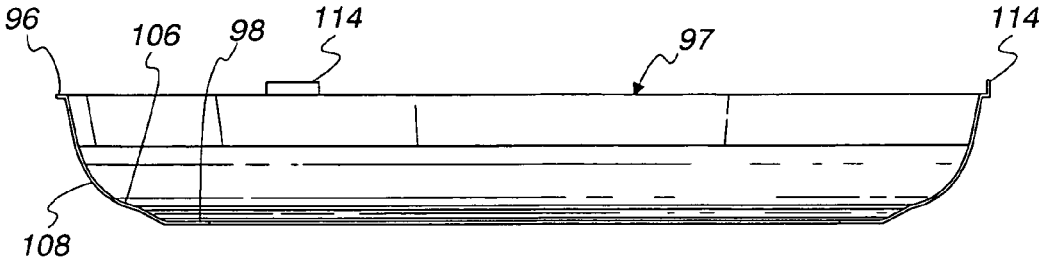
FIG. 18 is a cross and sectional view taken along the line 18-18 of FIG. 17.

Referring now to FIG. 16, further details concerning of the shape of susceptor ring 92 will now be described with reference to an alternative embodiment of ring 92. Susceptor ring 92 is shown with a series of tabs 114 located at the bottom edge 96. Ring 92 shown in FIG. 16 is preferably employed with a pan member 42 shown for example in FIGS. 13-15. The tabs 114 are received in slots formed at or adjacent the upper rim 48 of component 42. The ring of FIG. 16 shows optional vent holes 95. If desired slots or slits could also be used for venting. Cooperation of the tabs and slits formed in pan 42 ensure that ring 92 is placed properly when used. As mentioned, ring 92 preferably performs a molding function for the expanding dough and it has been found important in certain instances to provide added alignment of ring 92 about the food product based on component 42. As shown in FIGS. 17 and 18, a number of concentric circular portions are formed into the preferred embodiment of ring 92. As mentioned, the ring is preferably made of paper board material and a suitable susceptor coating is applied to its inner surface in order to achieve the desired shape and structure indicated in FIGS. 16-18. The paper board base of ring 92 is preferably formed in a press using conventional techniques.

Figure 20:
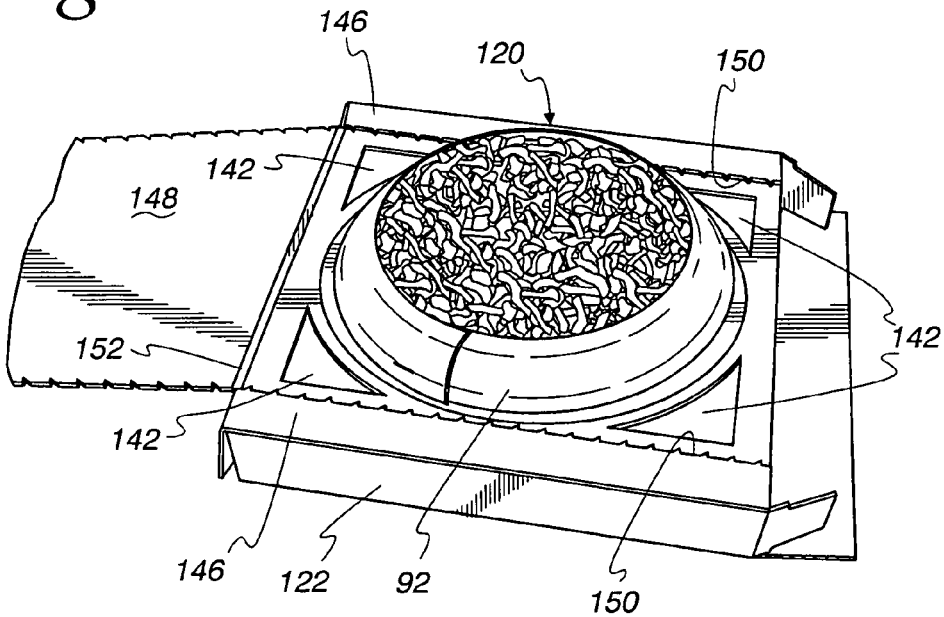
FIG. 20 is a perspective view of another multi-purpose food preparation kit.
Figure 21:
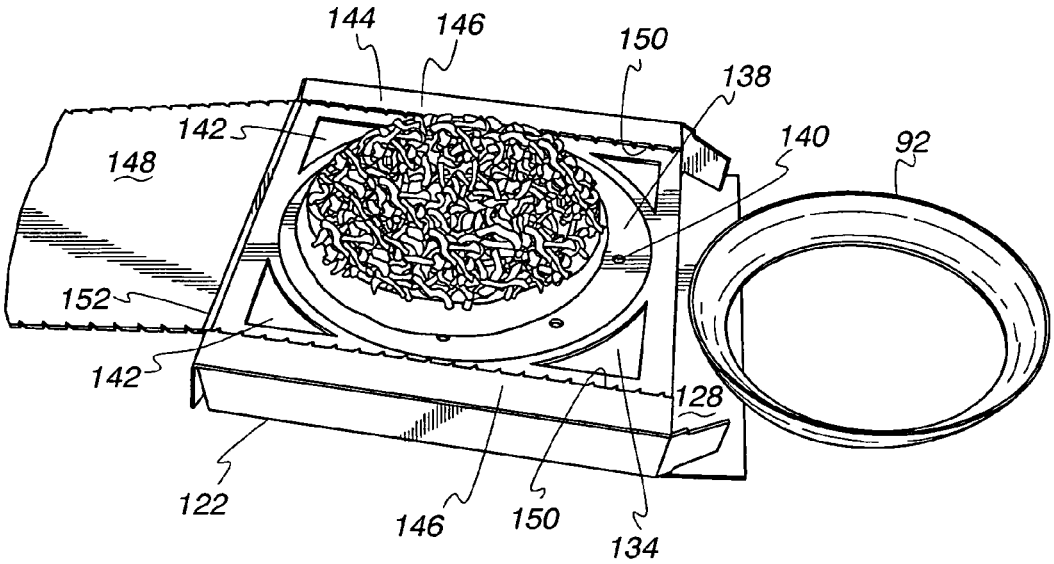
FIG. 21 shows the kit of FIG. 20 with a ring component removed and inverted.
Figure 22:
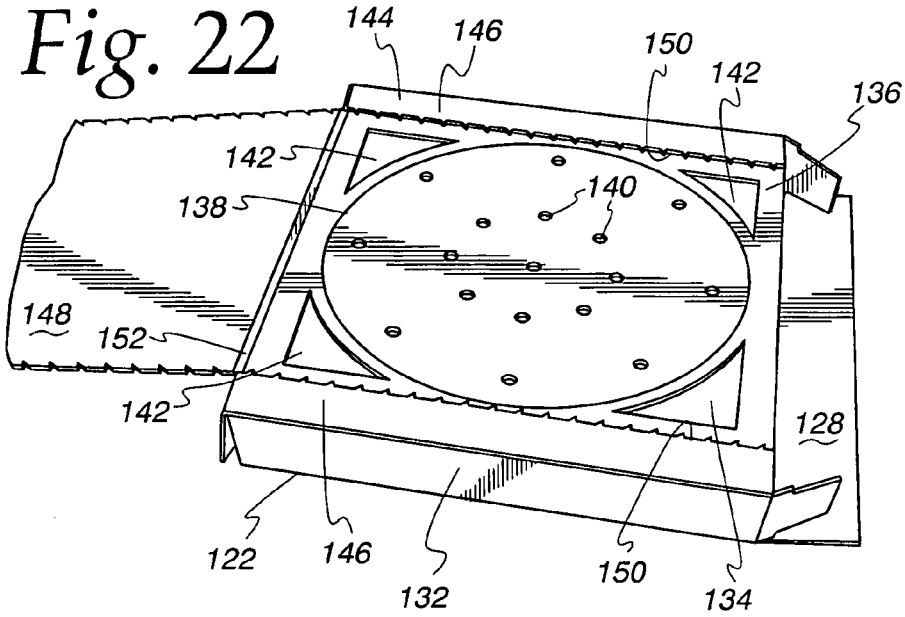
FIG. 22 is a perspective view showing the carton component thereof.

Referring now to FIGS. 20-23, a multi-purpose food preparation kit is generally indicated at 120. Kit 120 includes the ring 92 described above and a multipurpose carton 122 which provides packaging, cooking, browning and crisping for the frozen pizza food product 58. Preferably, carton 122 is used for shipping the food product without requiring an overwrap or other materials. FIG. 21 shows the kit 120 with ring 92 removed, while FIG. 22 shows the carton 122, separate from the ring and food product. Carton 122 includes front and rear walls 128, 130 and side walls 132. The carton 122 also includes a floor 134 and an interior wall 136. Interior wall 136 includes a central portion 138 coated with a suitable susceptor material. As shown in FIG. 22, central portion 138 is also perforated with a series of holes 140. A series of optional vent cut outs 142 are formed at the corners of interior wall 136.

Carton 122 also includes an outer top wall 144 which extends between sidewalls 132 a front and rear walls 128, 130 and overlies interior wall 136. Top wall 144 is divided by the end user into three parts including the strip-like parts 146 and a central lid part 148. If desired lid part 148 could be made removable. Preferably, top wall 144 is formed as a continuous-one piece panel which is divided by lines of weakness 150, preferably in the form of conventional tear strip portions. As shown in FIG. 22, with the tear strip portions removed, lid 148 is free to open to expose interior wall 136. Preferably, lid 148 is hinged at 152 to rear wall 130. In use, the end user frees lid 148, exposing the susceptor-coated portion of interior wall 136. The food product shipped within the interior of the container is removed along with the susceptor ring also shipped within the carton. The kit is then prepared for a cooking cycle as illustrated in FIG. 20. If desired, the hinge 152 connecting lid 148 to the carton can be weakened with a tear line to allow removal of lid 148 prior to the cooking cycle. The food product and associated cooking components of kit 20, such as the susceptor ring 92, may be readied for shipment to an end user utilizing the carton 122 as an outer shipping container without requiring additional packaging.

As mentioned, it is important that moisture from the food product be allowed to exit through holes 140, so as to reside within the hollow interior cavity of carton 122. A certain amount of steam or moisture vapor is retained within the carton interior to heat the underside of the food product and excess moisture is allowed to vent through openings 142. If desired, front wall 128 can be opened to provide further venting of moisture, if desired. In other embodiments all vents and openings in the carton can be omitted. This may be particularly useful for smaller food items.

Figure 23:
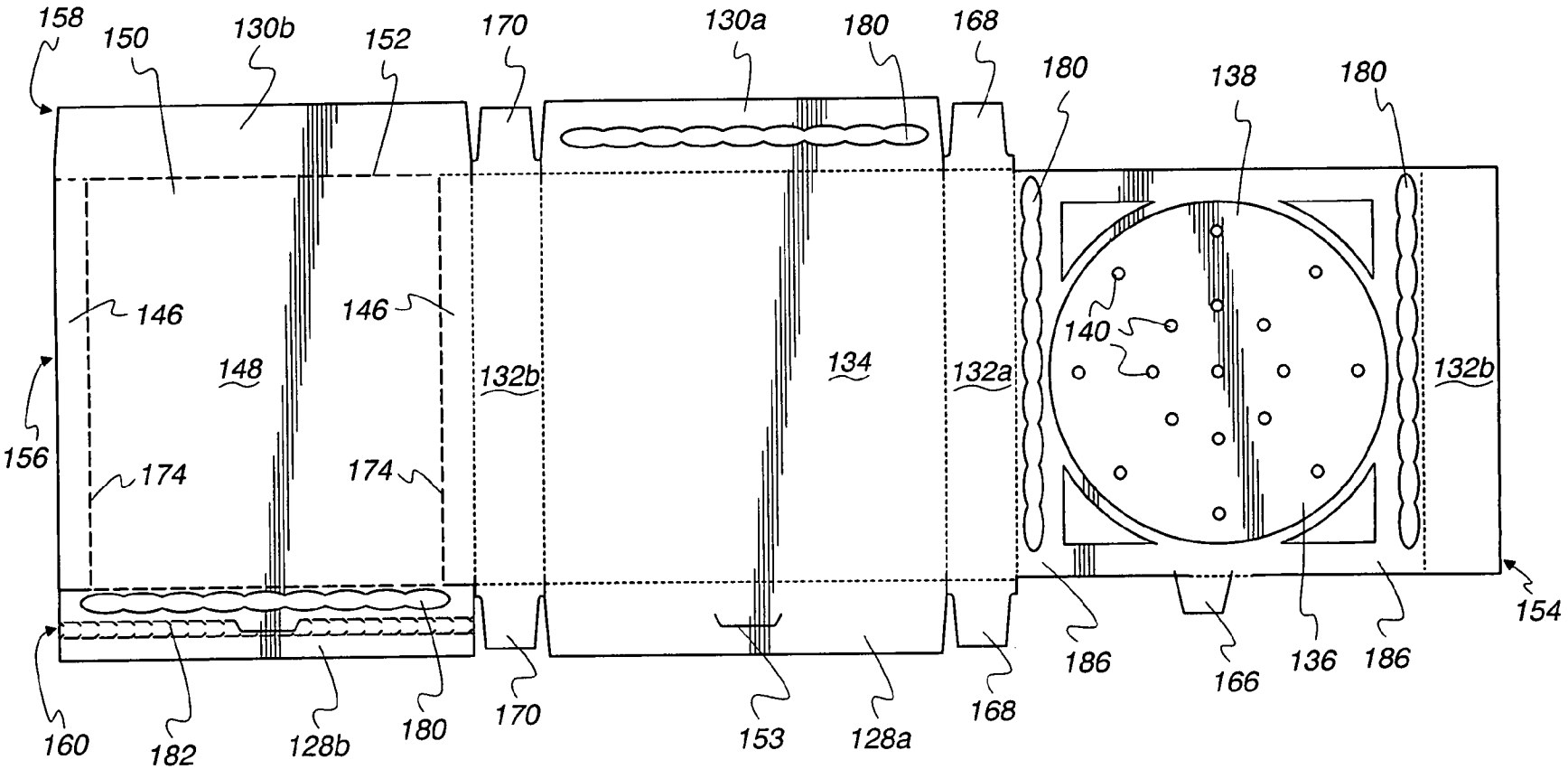
FIG. 23 is a plan view of the blank from which the carton of FIG. 22 is prepared.

Referring now to FIG. 23, a carton blank 154 used to construct carton 122 is shown. Carton blank 154 is preferably formed from a single unitary sheet of paper board material and is divided by hinge lines to form various panels and flaps required for the carton construction. The outer surfaces of the carton panels and flaps are shown in FIG. 23, so as to render visible the susceptor coatings and adhesive strips applied to the paper board substrate. Carton blank 154 includes a central column generally indicated at 156 disposed between side columns 158, 160. As indicated in FIG. 23, the columns 156-160 are non-coterminous, for optimizing carton blank material in a carton blank from a single unitary sheet of paper board.

As can be seen in FIG. 23, central column 156 comprises a serial succession of hingedly joined panels. A side panel 132*b* is located at the top of blank 154 and is joined to intermediate wall panel 136. Side portions 186 of panel 136 are coated with strips of adhesive 180. Next, side panel 132*a* is joined to bottom panel 134 which in turn is connected to another side panel 132*b*. A top cover panel 150 is located at the bottom panel of the carton blank and includes a central lid panel 148 flanked by strip portions 146.

Referring to the right hand portion of FIG. 23, column 160 includes end flaps 168 followed by end wall panel 128*a* having a tab-receiving slit 153. Next, end flap 170 is followed by end wall panel 128*b* which contains a tear strip 182 and a strip of adhesive 180.

Referring to the left hand portion of FIG. 23, end flap 168 is followed by end wall panel 130 a which includes a strip of adhesive 180. End flap 170 is then followed by end wall panel 130*b*.

Carton blank 154 is folded along the indicated fold or hinge lines, which are shown as dashed lines in FIG. 23. The intermediate wall 136, side wall 132*a* and bottom wall 134 are folded at right angles so as to bring the two side wall panels 132*b* into overlying relationship with one another. The top panel 150 is then folded over intermediate wall panel 136 so as to bring the adhesive strips 180 of panel 136 into contact with strip portions 146 of top wall 150. Next, the rear end wall panel 130*b* is folded over panel 13*a* four adhesive joinder with the strip 180 carried on panel 130*a*. Front wall panel 128*a* is then the joined to the adhesive strip 180 carried on panel 128*b*. As mentioned above with respect to FIG. 22, an end user grasps the front end of lid 148, tearing of the lid free of side strips 146, and swinging the lid 148 about hinge line 152, to expose the central susceptor coated portion 138 of panel 136.

Figure 24:
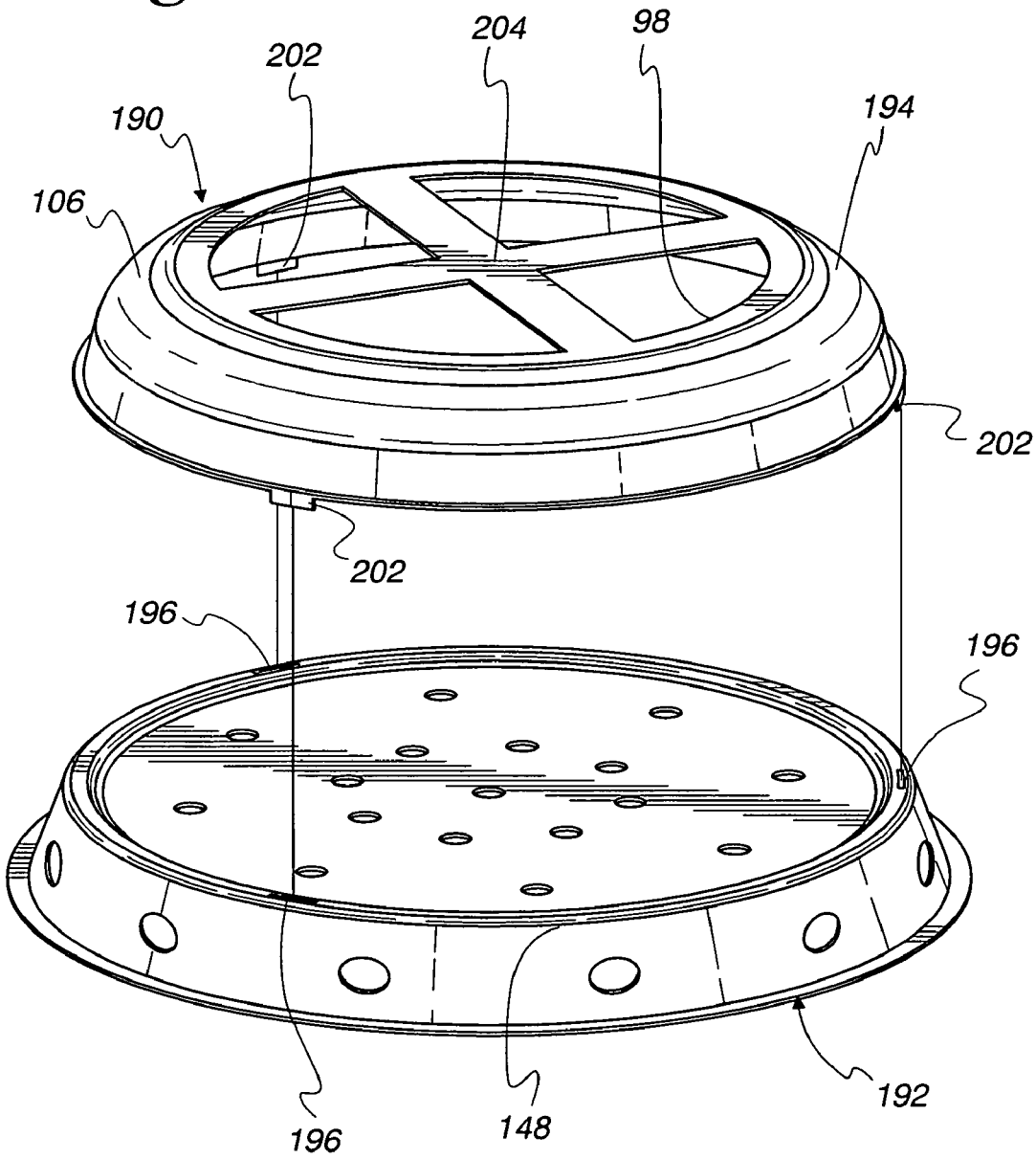
FIG. 24 is an exploded perspective view of another multipurpose food preparation kit.

Turning now to FIG. 24, a multi-purpose food preparation kit 190 includes a base 192 and a susceptor ring 194. Base 192 is substantially identical to the base 42 described above except for the addition of slits or notches 196 formed in the upper rim 48. Susceptor ring 194 is substantially identical susceptor ring 92 described above except for the addition of tabs 202 downwardly depending from bottom edge 96. As indicated in FIG. 24, tabs 202 are received in notches 196 to provide alignment of ring 194 with respect to base 192. Susceptor ring 194 further includes an x-shaped handle extending from the central edge 98 of the ring. Edge 98 is formed at the upper extent of raised rim portion 106 of the ring, exposed above the food product. Accordingly, handle 204 is elevated above the top of the food product and can be readily grasped after a cooking cycle to facilitate removal of the ring 194 after the cooking cycle is completed.

Figure 25:
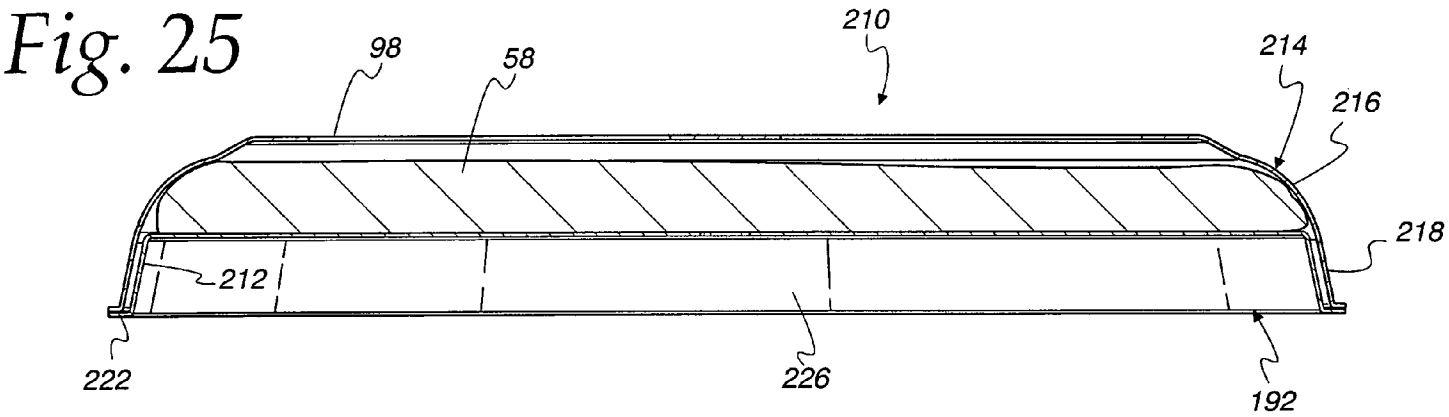
FIGS. 25 and 26 are cross-sectional views showing another multipurpose food preparation kit.
Figure 26:
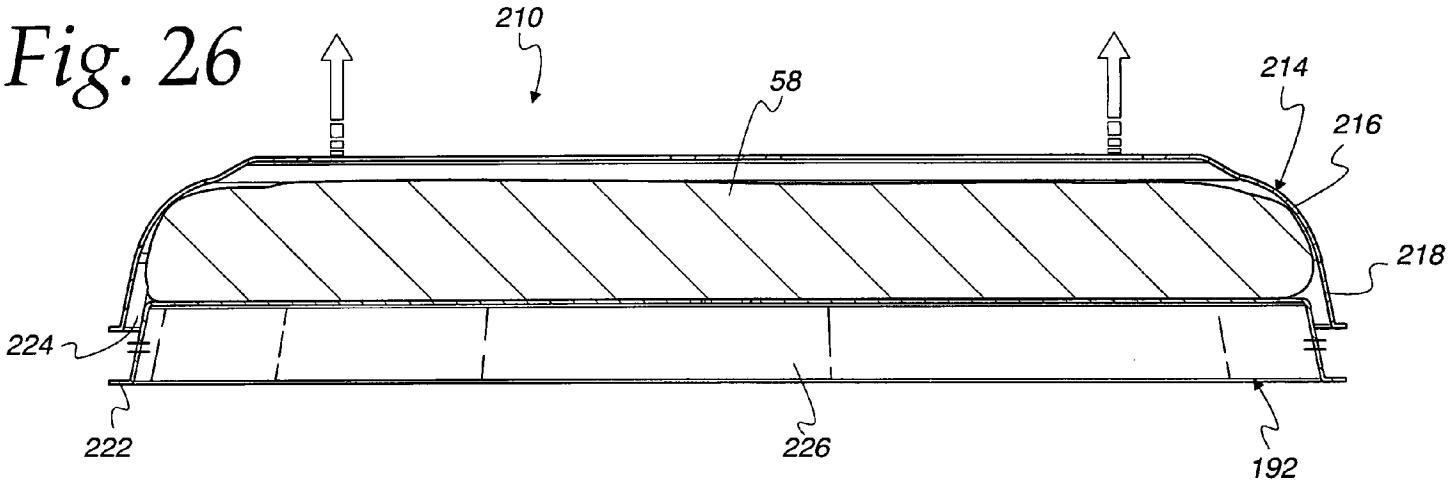

Turning now to FIGS. 25-26, a multi-purpose food preparation kit 210 includes a base 212 and a susceptor ring 214. Susceptor ring 214 includes an upper portion 216 substantially identical to susceptor ring 92 and a lower generally cylindrical or frustoconical extension portion 218 which in effect extends the bottom edge of the ring 92 downwardly adjacent and outer rim 222. With reference to FIG. 25, it is generally preferred that susceptor ring 216 initially is out of contact with the crust rim of food product 58. The bottom portion of susceptor ring 214 may contact ring 222 or be spaced slightly above the rim. In FIG. 25, food product 58 is shown midway through a cooking cycle and comprises a frozen pizza having a peripheral exposed dough rim or crust rim. The dough rim in the preferred embodiment is formed of raw or unproofed dough. Referring to FIG. 26, food product 58 is shown at the end of the cooking cycle, after the dough expansion phase. As mentioned above, a 6 inch pizza made with raw dough undergoes a doubling of height at its crust rim. The height increase causes the susceptor ring 214 to elevate, causing a substantial gap 224 between the bottom edge of the susceptor ring and rim 222. In the preferred embodiment, base 212 is identical to base 42 described above which includes aperatures or vent holes in its side wall. Moisture entering cavity 226 is vented through holes in the wall, passing through gap 224. The gap 224 increases from an initial minimum value indicated in FIG. 25 to a maximum value indicated in FIG. 26. As the cooking cycle progresses, the gap size continuously increases as the dough rises. Thus, the kit 210 provides a dynamic venting during the cooking cycle which optimizes the rate of moisture escape during the cooking cycle.

Figure 27:
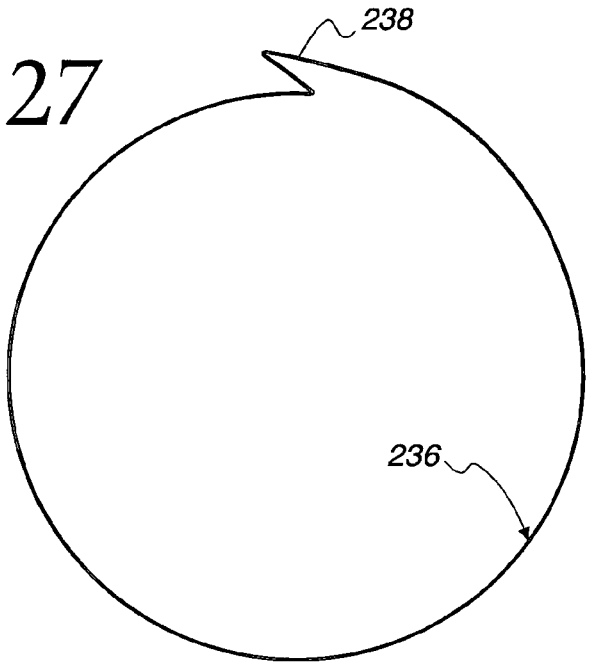
FIGS. 27 and 28 are top plan views of a susceptor ring component.
Figure 28:
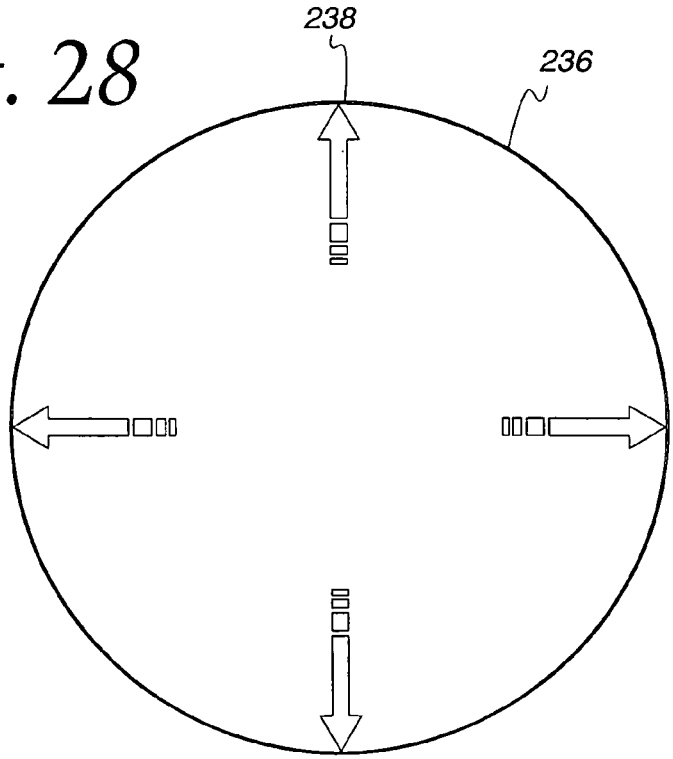

Turning now to FIGS. 27-28, a susceptor ring 23 has a substantially cylindrical configuration except for an overlapping pleat portion 238. As pizza dough within ring 236 rises and expands, the pleat portion 238 is opened to provide an automatic size increase, for the susceptor ring so as to avoid undue constriction of the rising dough. In FIG. 28, susceptor ring 236 is expanded to conform to the enlarged size of the food product.

Figure 29:
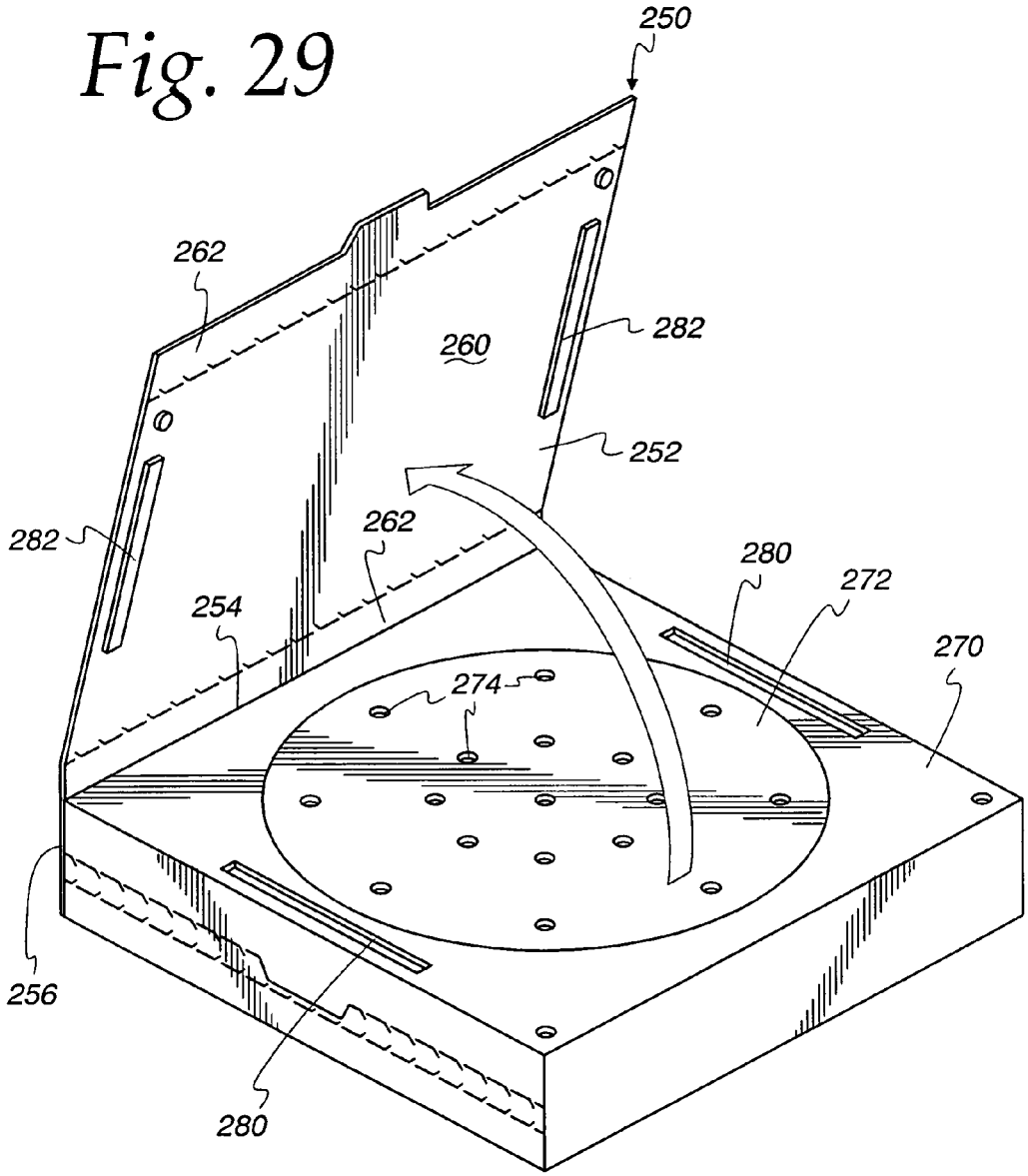
FIG. 29 is a perspective view of a carton component.
Figure 30:
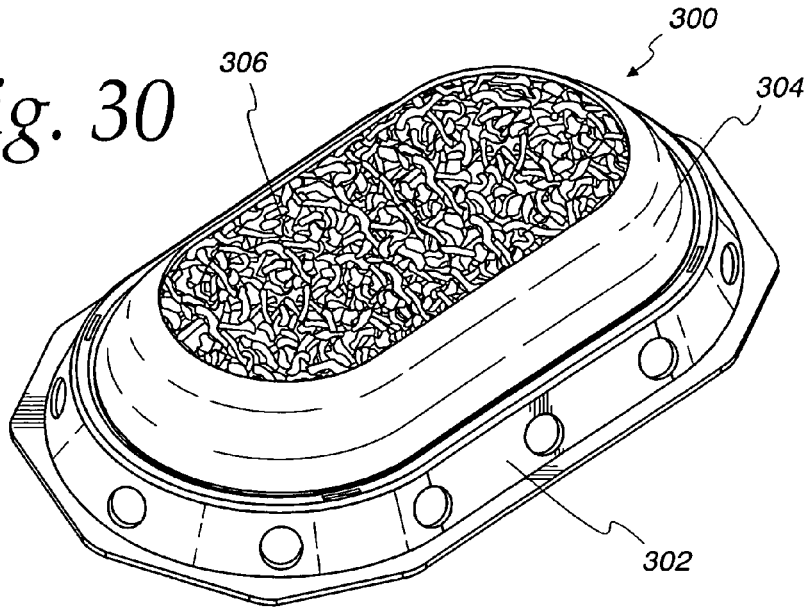
FIG. 30 is a perspective view of another multi-purpose food preparation kit.

Referring now to FIG. 29, a carton for use with a multi-preparation kit is generally indicated at 250. Carton 250 is preferably employed with susceptor ring 92 in an arrangement similar to that illustrated in FIG. 20. By comparison with carton 122, vents are located in the sides of the carton 250, midway between its front and rear ends. As will be seen herein, the vents are formed by an adhesive joined of overlying top wall and an underlying interior wall during shipment. This allows the package to have a relatively tight seal at the package mid portion. And shown in FIG. 29, a top wall 252 is hingedly adjoined at 254 to a rear wall 256 of the carton. Top wall 252 includes a central lid portion 260 joined by tear lines 266 to strip portions 262.

An intermediate wall 270 contains a susceptor coating 272 ventilated by optional holes 274. The vent holes 280 are defined by lines of weakness in intermediate wall 270. Material removed from intermediate wall 270 appears as strips 282 adhered to top wall 252 by adhesive, not shown. Initially, strips 282 are received in vent holes 280 and form part of intermediate wall 270. A user grasps the central lid portion 260, tearing it from strip portions 262 which are secured to intermediate wall 270 by adhesive, not shown. Adhesive applied to top wall 252 joins the top wall to strips 282, which are removed along with the lid portion 260. In this manner, vent holes are automatically provided in preparation for a cooking cycle. If desired the vent holes 280 can be omitted.

Figure 32:
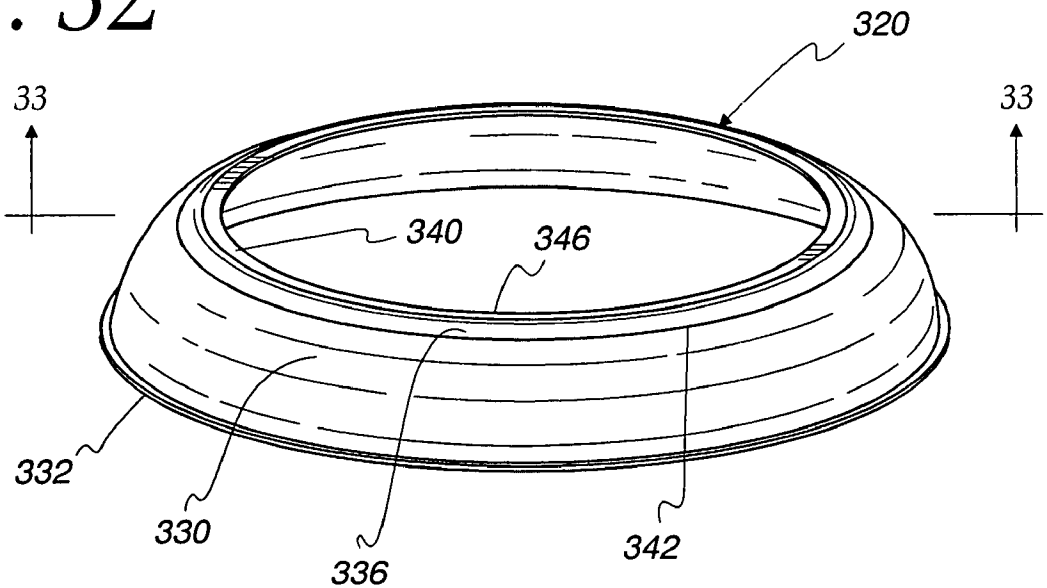
FIG. 32 is an exploded perspective view of another multipurpose food preparation kit.
Figure 33:
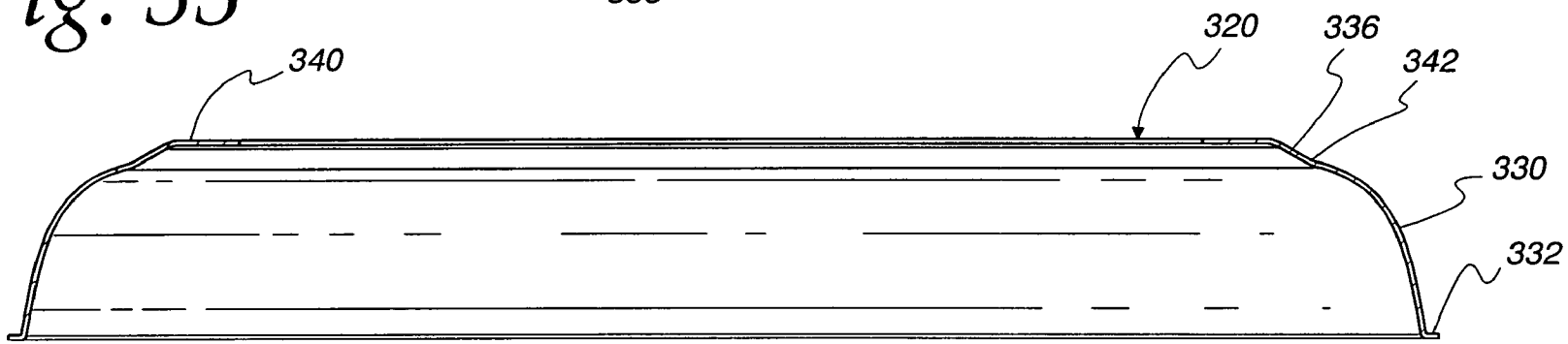
FIG. 33 is a cross-sectional view taken along the line 33-33 of FIG. 32.

Turning now to FIGS. 32-35 a multi-purpose food preparation kit is shown, employing the same support 42 or susceptor base described above, with reference to FIGS. 4-6, for example. Support 42 is shipped in an inverted position as shown in FIGS. 32 and 33. In use, support 42 is removed from a shipping carton 304 and inverted to an operational position, as explained above. Shipping carton 304 has generally rectangular walls, and includes a tear strip opening 306, at one end, as illustrated in FIG. 32. As shown in FIGS. 32 and 33, kit 300 also includes a sealed internal package 310. Package 310 includes a bottom-rigid plastic tub or tray 312 having an upper peripheral sealing lip. Package 310 further includes an upper flexible sheet 316 having an outwardly protruding pull tab 318 to allow easy separation of flexible sheet 316 from tray 312. It is generally preferred that the upper flexible film 316 and lower tray 312 be joined together using conventional peel seal technology. Use of the plastic over wrapping around the food product and susceptor ring allows conventional air displacing technologies such as nitrogen flushing to increase shelf life and if necessary, to maintain desired properties of the susceptor material.

Referring to FIGS. 32 and 33, internal package 310 is received within the inverted support 42 for a compact fit within carton 304. Included within internal package 310 is the frozen pizza food product 58 and a susceptor ring component 320 shown in greater detail in FIGS. 34 and 35. On removal of the internal package 310 from carton 304, the internal package is opened by pulling tab 318, separating flexible sheet 314 from lower tray 312. As shown in FIG. 33, it is generally preferred that upper sheet 314 and lower tray 312 be extended throughout the length of tab 318, with a bifurcated or unsealed opening 322 at the tip of tab 318 to facilitate an easy start for the opening process.

Figure 34:
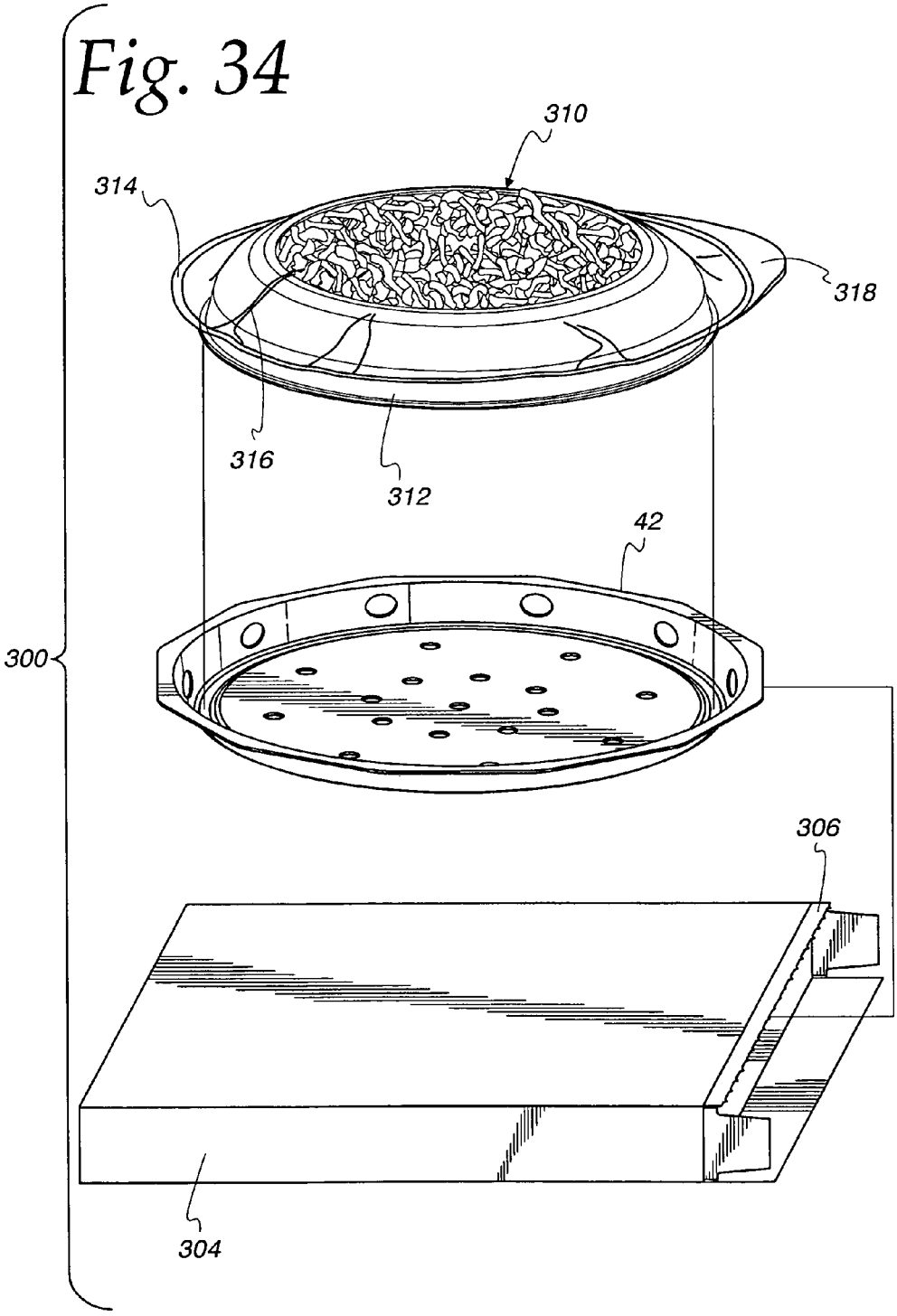
FIG. 34 is a perspective view of the susceptor ring component thereof.
Figure 35:
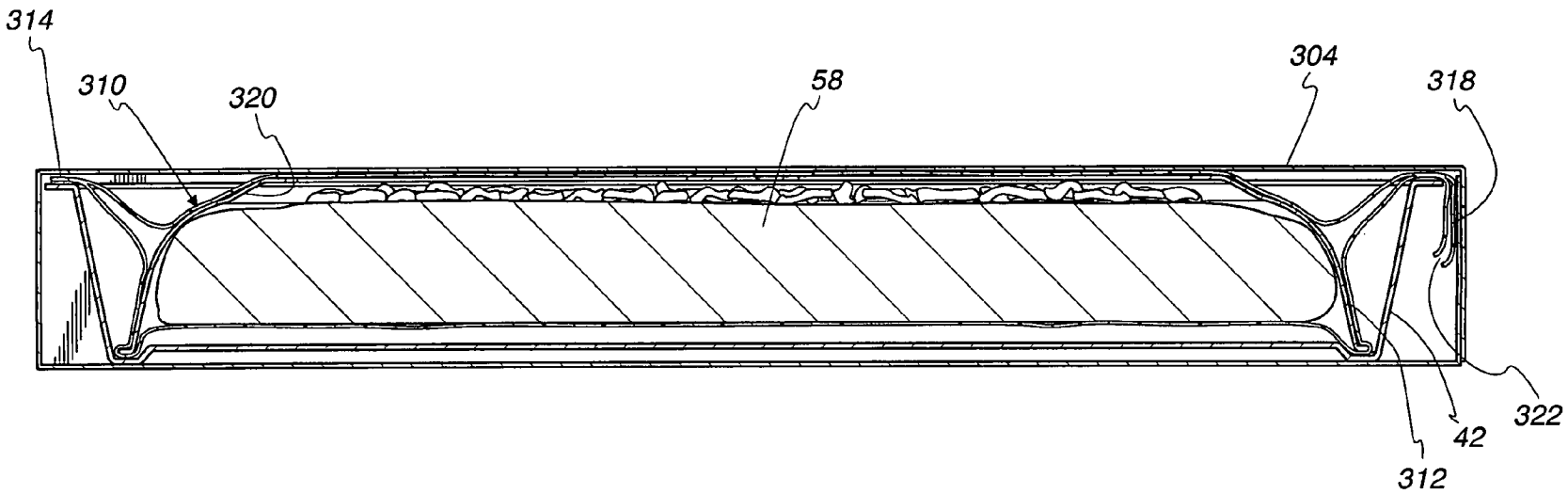
FIG. 35 is cross-sectional view taken along the line 35-35 of FIG. 34.

Turning now to FIGS. 34 and 35, susceptor ring 320 has a continuously curved concave lower wall portion 330 terminating in a lower flange 332. Susceptor ring 320 further includes an upper wall portion 336 of substantially smaller size than the lower wall portion 330, and can have either a concave continuously curved shape or a frustoconical shape. It is generally desirable to form the susceptor ring 320 from thin gauge molded plastic material, so thin as to require reinforcing features such as creases to reduce buckling or other deformation. Accordingly, it is generally preferred that the bottom of the susceptor ring include an outwardly extending flange 332 and at the upper part an inwardly extending flange 340. It is generally preferred that the central opening 346 at the upper end of the susceptor ring 320 be formed by cutting or blanking material from the molded plastic product 320 to provide the central opening indicated in the figures, and could have vent openings if desired.

If desired, the wall portion 336 can be relied upon to provide stiffening of the upper portion of the susceptor ring such that inwardly extending flange 340 can be eliminated. As mentioned, upper and lower wall portions 336, 330 are blended together, as indicated in the cross-sectional view of FIG. 35. Regardless of whether the upper wall portion 336 is formed with a concave shape or a frustoconical shape, a discontinuity, crease, or corner 342 is formed between the upper and lower wall portions 336, 330 to provide rigidity to the susceptor ring, allowing the susceptor ring component to be formed as a relatively thin plastic molding. The susceptor ring component is then coated with a conventional susceptor material.

If desired, materials other than plastic can be used for susceptor ring 320. Virtually any conventional material can be used, such as molded paper or paperboard of the type used to make conventional paper plates with stiffening agents such as starch or other material if desired. As a further example, the susceptor ring can be made of ceramic material or other material of mineral composition and can be prepared from homogenous material or layered materials formed into a final sheet product or a sheet product which is coated after molding.

It is generally preferred that the susceptor rings, including susceptor ring 320 be sized larger than the frozen pizza food product as explained in other embodiments, above. As a result, when cooking is initiated, a substantial portion of the peripheral crust of the pizza is out of contact with susceptor ring 320. With continued cooking, the susceptor ring 320 is heated to a higher temperature than otherwise possible if the susceptor ring were in contact with the food product. Based upon the size difference between the susceptor ring and food product and rate of energy input of the oven, an average time delay can be calculated for the initial contact of the food product with the susceptor ring. Accordingly, an average temperature rise of the susceptor ring prior to contact with the food product can be predicted. Thus, an accurate cooking cycle for a particular susceptor ring and food product can be established to provide the desired consumer satisfaction by having a peripheral crust which is brown and crispy, without being dried. If desired, the height of the susceptor ring can be chosen to remain in contact with the upper rim 48 with support 42 (see for example FIGS. 13 and 14) throughout the cooking cycle. Alternatively, the height of the susceptor ring can be chosen such that the bottom edge of 332 of the susceptor ring is lifted above the upper rim 48 of support 42 at a predetermined time during the cooking cycle, so as to achieve a final desired separation distance. When provided, the separation distance between the susceptor ring and the support 42 provides a controlled, defined venting of steam emanating from food product. Thus, any excess moisture contained in the food product can be released in a controlled manner to provide a cooked food product which meets the customer's expectations.

As with the preceding embodiments, it is generally preferred that the upper opening of the susceptor ring remain out of contact with the pizza toppings of the food product. Thus, the susceptor ring does not directly control cooking of the central portion of the food product, but can be effectively employed to match the rate of cooking of the outer periphery to central portions of the food product, so as to provide a cooked product having portions of different composition prepared according to the consumer's expectations, without requiring consumer intervention during the baking process.

Figure 36:
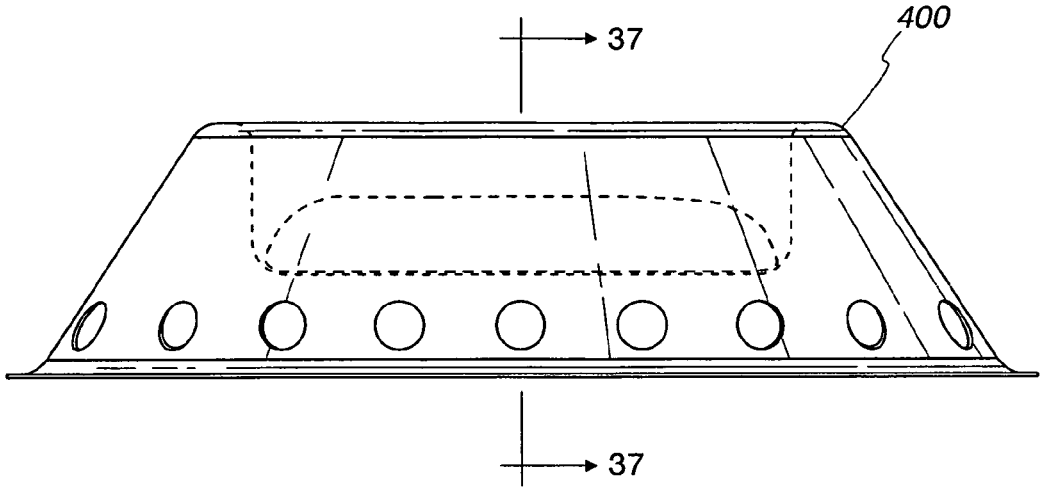
FIG. 36 is an elevational view of a multipurpose food receptacle.
Figure 37:
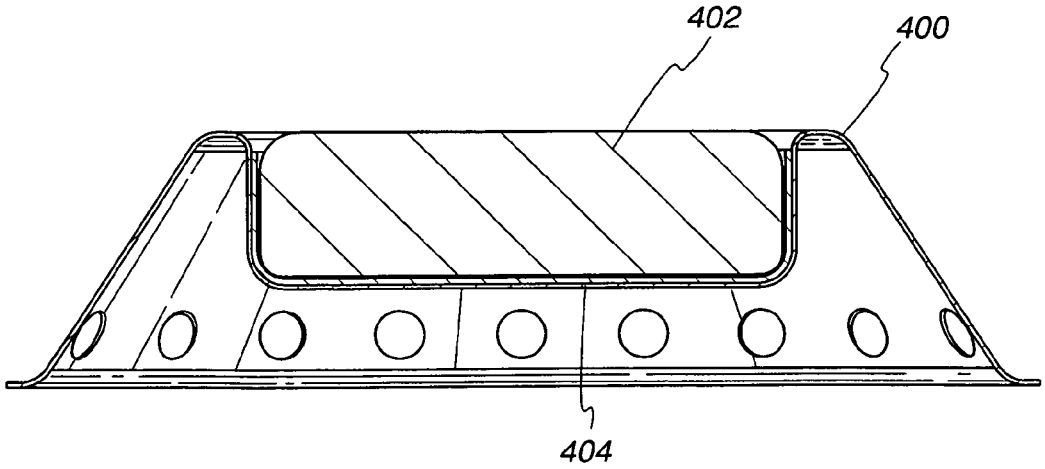
FIG. 37 is a cross-sectional view taken along the line 37-37 of FIG. 36

Referring now to FIGS. 36 and 37 a receptacle is shown for transporting and cooking a food product such as a frozen pizza. The receptacle 400 generally resembles the support based 42 described above and is constructed in a similar fashion. However, receptacle 400 has a recessed center portion which is dimensioned deep enough to receive the fully cooked food product 402 as can be appreciated, receptacle 400 is particularly attracted for deep dish pizza and food products having a substantial height. As with the support 42, the bottom wall 404 of receptacle 400 is elevated above a table surface which allows cooking energy, such as microwaves to penetrate the sides of the receptacle, reflect off of the oven surface and contact the bottom of the food product.

Figure 38:
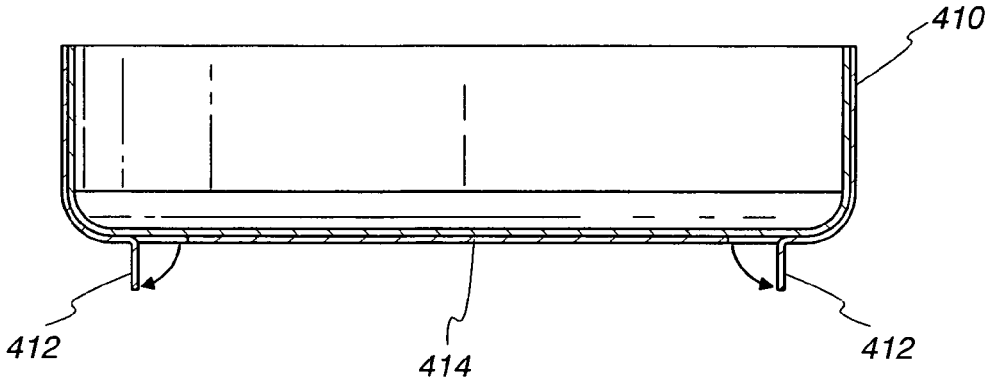
FIG. 38 shows another food receptacle.

Referring to FIG. 38 a receptacle 410 is similar in construction to receptacle 400 but lacks the outer frustoconical wall which raises the food product above the oven service, during cooking. Instead, receptacle 410 has a series of legs 412 which are struck out of the bottom wall 414. Preferably, legs 412 are spaces apart from one another. Preferably, receptacle 410 is made of the same materials and constructed using the same techniques as support 42, described above.

Figure 39:
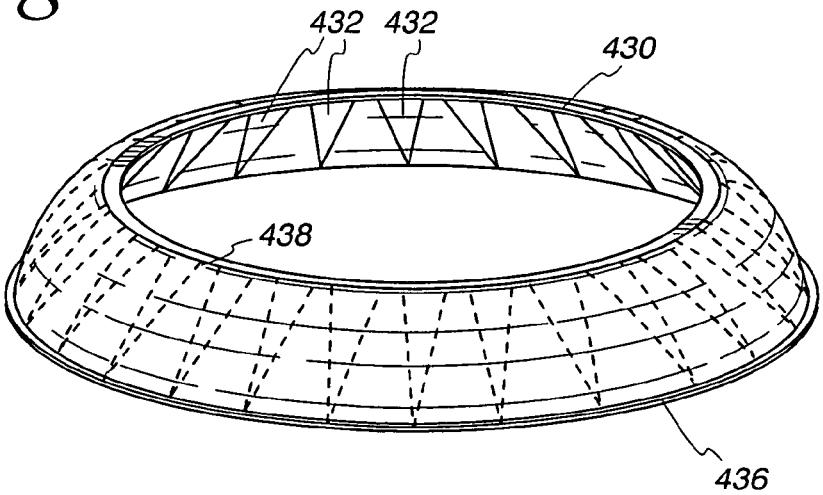
FIG. 39 is a perspective view of a susceptor ring component.

Referring to FIG. 39 a susceptor ring 430 is substantially to identical to susceptor ring 92 described above, except that the susceptor coating located on the interior of the susceptor ring 430 does not completely cover the interior surface of the susceptor ring. As shown in FIG. 39, the susceptor coating 432 is formed as a series of portions spaced apart at there lower ends. In this manner, the susceptor coating cover 430 is grated or graduated to provide desirable cooking results. As shown in FIG. 39, less heating is experienced at the bottom edge 436 then at the upper end 438. By graduating the amount of susceptor coating over heating of certain portions of the food product can be avoided during cooking. For example, the outer dough rim of a frozen pizza food product will be spared any drying out, over crisping, or other over cooking. Virtually any pattern of susceptor coating on the interior surface of the ring can be employed. For example, the susceptor material can be coated as a series of space-apart diagonal stripes or can comprise an array of dots or other shapes which are grated in size and spacing from the top to the bottom of the susceptor ring.

The drawings and the foregoing descriptions are not intended to represent the only forms of the components and kits in regard to the details of construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation.

We claim:

1. A method for the microwave cooking, browning and crisping of a rising dough rim having a first smaller uncooked size and a second larger cooked size, including the steps of:

providing a susceptor support for supporting the rising dough rim;

placing the rising dough rim on the susceptor support;

providing a susceptor ring having a size larger than the first size of said rising dough rim, approximately equal to the second size of said rising dough rim;

placing said susceptor ring over said rising dough rim;

heating said susceptor support, susceptor ring and rising dough rim in microwave oven;

continuing said heating step so as to heat said susceptor ring so as to cause said rising dough rim to rise, growing in size approaching said second, larger cooked size;

continuing said microwave heating until said rising dough rim contacts said susceptor ring;

continuing said microwave heating until said rising dough rim increases in size so as to conform to said susceptor ring; and continuing said microwave heating to cause said rising dough rim to grow in height while maintaining the surface of rising dough rim to conform to the susceptor ring to raise the susceptor ring above the susceptor support, so as to form a vent space between said susceptor ring and said susceptor support.

2. The method of claim 1 further comprising the step of providing said susceptor ring with a plurality of spaced-apart downwardly extending tabs and providing said susceptor support with a plurality of spaced-apart slots to receive said tabs and to guide said tabs during initial lifting of said susceptor ring above said susceptor support.

3. The method of claim 1 wherein said susceptor ring includes a support ring portion above the susceptor surface to provide an extender support for said susceptor ring which remains out of contact with said rising dough rim.

4. The method of claim 1 wherein said susceptor ring initially contacts and is supported by said support wall and is raised above said susceptor support during cooking of said rising dough rim to form a vent area between said susceptor ring and said support wall such that said susceptor ring is heated during lifting of said rising dough rim prior to contact with said rising dough rim.

5. The method of claim 1 wherein said susceptor ring includes a plurality of spaced-apart downwardly extending tabs and said support wall defines a plurality of spaced-apart slots to receive said tabs and to guide said tabs during cooking of said food item.

6. The method of claim 1, wherein the susceptor ring includes a peripheral footing that is configured to rest on the raised peripheral rim of said food support surface prior to rising of the rising dough rim.

7. The method of claim 6, wherein the depressed central portion of the food support surface is generally planer and a curved segment joins the depressed central portion and the peripheral footing.

8. The method of claim 7, wherein the peripheral footing has a generally planar segment that is substantially parallel to the depressed central portion of the food support surface.

9. A food product kit, for cooking, browning and crisping a rising dough rim having a first smaller uncooked size and a second larger cooked size, comprising:

a support wall with a susceptor food support surface portion supporting said rising dough rim, the support wall elevating the susceptor food support surface portion and cooperating with the support surface portion to form a substantially enclosed cavity beneath the support surface portion;

a susceptor ring for use above said food support surface portion having a susceptor surface facing both a top and a side of said rising dough rim, said susceptor ring having a size larger than the first uncooked size of said rising dough rim, approximately equal to the second, larger, cooked size of said rising dough rim and sized to fit within the cavity beneath the support surface portion; and said susceptor ring freely supported above said rising dough rim such that, as said rising dough rim is cooked, said rising dough rim rises and contacts said susceptor surface effective to conductively heat, brown and crisp at least a portion of said rising dough rim and is subsequently confined in size by said susceptor surface, wherein said susceptor ring includes a plurality of spaced-apart downwardly extending tabs and said support wall defines a plurality of spaced-apart slots to receive said tabs and to guide said tabs during cooking of said food item.

* * * * *